US009656467B2

(12) United States Patent
Kakiuchi et al.

(10) Patent No.: US 9,656,467 B2
(45) Date of Patent: May 23, 2017

(54) PIEZOELECTRIC ACTUATOR, LIQUID DISCHARGING APPARATUS AND METHOD FOR PRODUCING PIEZOELECTRIC ACTUATOR

(71) Applicant: Brother Kogyo Kabushiki Kaisha, Nagoya-shi, Aichi-ken (JP)

(72) Inventors: Toru Kakiuchi, Chita-gun (JP); Hideki Hayashi, Nagoya (JP); Keita Hirai, Nagoya (JP); Atsushi Hirota, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/757,550

(22) Filed: Dec. 24, 2015

(65) Prior Publication Data

US 2016/0185116 A1 Jun. 30, 2016

(30) Foreign Application Priority Data

Dec. 26, 2014 (JP) ..... 2014-265265

(51) Int. Cl.
*B41J 2/045* (2006.01)
*B41J 2/14* (2006.01)
*B41J 2/16* (2006.01)

(52) U.S. Cl.
CPC ..... *B41J 2/14201* (2013.01); *B41J 2/14233* (2013.01); *B41J 2/161* (2013.01);
(Continued)

(58) Field of Classification Search
CPC .... B41J 2/14201; B41J 2/14233; B41J 2/161; B41J 2/1628; B41J 2/1629; B41J 2/1631;
(Continued)

(56) References Cited

U.S. PATENT DOCUMENTS 6,471,342 B1 10/2002 Horio et al.
7,607,765 B2 * 10/2009 Iriguchi ..... B41J 2/14209 347/72

(Continued)

FOREIGN PATENT DOCUMENTS

CN 1389349 A 1/2003
CN 101961955 A 2/2011

(Continued)

OTHER PUBLICATIONS

May 24, 2016—(EP) Extended Search Report—App 15202746.2.
Feb. 4, 2017—(CN) Notification of First Office Action—App 201510968969.2.

*Primary Examiner* — Juanita D Jackson
(74) *Attorney, Agent, or Firm* — Banner & Witcoff, Ltd.

(57) ABSTRACT

There is provided a piezoelectric actuator including: a plurality of piezoelectric elements forming first and second piezoelectric element rows, and including first, second electrodes and piezoelectric portion; an electrode conductive portion; a contact section; a plurality of drive wires; and conductive wires. A part of the drive wires corresponding to the piezoelectric elements of the second piezoelectric element row are extended toward the contact section while passing between two adjacent piezoelectric elements of the first piezoelectric element row which are adjacent in the first direction. The conductive wires are arranged between two adjacent piezoelectric elements of the second piezoelectric element row, each of the conductive wires is conducted, at two locations thereof apart in the second direction, with the electrode conductive portion.

17 Claims, 12 Drawing Sheets

(52) U.S. Cl.
CPC ..... *B41J 2/1628* (2013.01); *B41J 2/1629* (2013.01); *B41J 2/1631* (2013.01); *B41J 2/1643* (2013.01); *B41J 2/1646* (2013.01); *B41J 2002/14266* (2013.01); *B41J 2002/14459* (2013.01); *B41J 2002/14491* (2013.01)

(58) Field of Classification Search
CPC ..... B41J 2/1643; B41J 2/1646; B41J 2002/14266; B41J 2002/14459; B41J 2002/14491
See application file for complete search history.

(56) References Cited

U.S. PATENT DOCUMENTS

| | | | |
|---|---|---|---|
| 8,210,656 | B2 | 7/2012 | Suzuki et al. |
| 2002/0080213 | A1 | 6/2002 | Shimada et al. |
| 2006/0203041 | A1 | 9/2006 | Shimada et al. |
| 2007/0070128 | A1 | 3/2007 | Inoue |
| 2007/0176977 | A1 | 8/2007 | Iriguchi |
| 2011/0018942 | A1 | 1/2011 | Suzuki et al. |

FOREIGN PATENT DOCUMENTS

| | | | |
|---|---|---|---|
| JP | 2000-079683 | A | 3/2000 |
| JP | 2000-094688 | A | 4/2000 |
| JP | 2005-212289 | A | 8/2005 |
| JP | 2006-255972 | A | 9/2006 |
| JP | 2011-025483 | A | 2/2011 |
| JP | 2013-119166 | A | 6/2013 |

* cited by examiner

PIEZOELECTRIC ACTUATOR, LIQUID DISCHARGING APPARATUS AND METHOD FOR PRODUCING PIEZOELECTRIC ACTUATOR

CROSS REFERENCE TO RELATED APPLICATION

The present application claims priority from Japanese Patent Application No. 2014-265265 filed on Dec. 26, 2014 the disclosure of which is incorporated herein by reference in its entirety.

BACKGROUND

Field of the Invention

The present invention relates to a piezoelectric actuator and a liquid discharging apparatus provided with the piezoelectric actuator.

Background Art

There is known an ink-jet head as a liquid discharging apparatus. The ink-jet head is provided with a head body formed with a plurality of nozzles and a plurality of pressure chambers communicating with the plurality of nozzles, respectively; and an actuator including a plurality of piezoelectric elements corresponding to the plurality of pressure chambers, respectively.

The plurality of pressure chambers in the head body are arranged corresponding to the plurality of nozzles, respectively, and construct four pressure chamber rows arranged side by side in a direction orthogonal to a nozzle aligning direction in which the nozzles are aligned. The actuator has a vibration plate covering the plurality of pressure chambers, a piezoelectric layer arranged on the vibration plate, and a plurality of individual electrodes which are arranged at an upper side of the piezoelectric layer while corresponding to the plurality of pressure chambers, respectively. A portion, of the piezoelectric layer, which corresponds to each of the pressure chambers is one piezoelectric element among the plurality of piezoelectric elements. Namely, the ink-jet head has a construction in which the plurality of piezoelectric elements are aligned in four rows in accordance with the alignment of the plurality of pressure chambers. Further, the vibration plate is formed of Cr (chromium) or a Cr-based alloy and faces the plurality of individual electrodes, with the piezoelectric layer being interposed between the vibration plate and the individual electrodes. The vibration plate also serves as a common electrode for the plurality of piezoelectric elements.

A plurality of electrical contact portions are arranged on the upper surface of the piezoelectric layer, at one end portion in the direction orthogonal to the arranging direction of the nozzles. From the plurality of individual electrodes constructing the piezoelectric elements aligned in four rows, a plurality of drive wires are extended toward the electric contact portions, respectively. Note that drive wires included in the plurality of drive wires and corresponding to piezoelectric elements, which are included in the plurality of piezoelectric elements and which constructs a piezoelectric element row included in the four piezoelectric element rows and located on a side opposite to the electric contact portions, are drawn through spaces between piezoelectric elements constructing another piezoelectric element row which is located closer to the electrical contact portions. An IC chip for applying voltage to each of the piezoelectric elements is connected to the electrical contact portions.

SUMMARY

There is known that, the electrical contact portions electrically connect not only the plurality of drive wires with the IC chip, but also electrically connects the common electrode (vibration plate) with the IC chip, in many cases, thereby applying a reference voltage (for example, the ground voltage) to the common electrode.

In this case, the distance from the electrical contact portions in the orthogonal direction orthogonal to the arranging direction of the pressure chambers is different among the plurality of piezoelectric element rows which are arranged side by side in the orthogonal direction. Namely, the distance to the electrical contact portions from electrode portions, in the common electrode, each of which faces one of the individual electrodes with the piezoelectric layer sandwiched therebetween and via each of which the voltage is applied to one of the piezoelectric elements, is different among the plurality of piezoelectric element rows. This in turn creates such a situation that in a piezoelectric element row, which is included in the four piezoelectric element rows and which is located far from the electrical contact portions, a path or route from the electrical contact portions to the electrode portions of the common electrode is longer than that in another a piezoelectric element row which is included in the four piezoelectric element rows and which is located close to the electrical contact portions.

In such a case that the path from the electrical contact portions to the electrode portions of the common electrode is longer, the voltage drop in the path becomes great when the piezoelectric elements are driven. Further, due to the difference in length of the above-described path among the plurality of piezoelectric element rows, the extent of the voltage drop is different among the piezoelectric element rows. Due to the difference in the voltage drop, the voltage applied to the piezoelectric elements is varied among the piezoelectric element rows, which in turn further causes the variation in discharge characteristic among the plurality of nozzles.

In order to suppress any variation in the applied voltage among the piezoelectric elements due to the difference in the length of the path, it is conceivable to increase the thickness of the common electrode such that the difference in voltage drop in the common electrode can be made small enough to be negligible. However, increasing the thickness of the common electrode involves such a problem that the deformation of the piezoelectric layer in the pressure chamber is hindered and thus the deformation efficiency is lowered.

An object of the present teaching is to suppress the voltage drop by increasing the number of path for electric current via which the electric current flows in the common electrode, and to thereby suppress the variation in the voltage applied to the piezoelectric elements among the plurality of piezoelectric element rows.

According to an aspect of the present teaching, there is provided a piezoelectric actuator including:

a plurality of piezoelectric elements aligned in a first direction on the substrate to form a first piezoelectric element row and a second piezoelectric element row which are arranged side by side in a second direction orthogonal to the first direction, each of the plurality of piezoelectric elements including a piezoelectric portion, a first electrode arranged on one side in a thickness direction of the piezoelectric portion, and a second electrode arranged on the other side in the thickness direction of the piezoelectric portion;

an electrode conductive portion electrically connecting the second electrodes with one another;

a contact section arranged on the substrate at a position on a side opposite to the second piezoelectric element row in the second direction relative to the first piezoelectric element row;

a plurality of drive wires each of which is extended in the second direction from one of the plurality of piezoelectric elements toward the contact section, each of the drive wires being connected to the first electrode of one of the plurality of piezoelectric elements, a part of the drive wires corresponding to the piezoelectric elements of the second piezoelectric element row being each extended toward the contact section while passing between two adjacent piezoelectric elements of the first piezoelectric element row which are adjacent in the first direction; and conductive wires arranged each between two adjacent piezoelectric elements of the second piezoelectric element row which are adjacent in the first direction, each of the conductive wires being conducted, at two locations thereof apart in the second direction, with the electrode conductive portion.

In the present teaching, the plurality of piezoelectric elements are arranged in the first direction to construct the two piezoelectric element rows (first and second piezoelectric element rows) arranged side by side in the second direction. Further, the drive wires included in the plurality of drive wires and corresponding to the piezoelectric elements included in the plurality of piezoelectric elements and constructing the second piezoelectric element row are each extended in the second direction while passing between two adjacent piezoelectric elements among the piezoelectric elements constructing the first piezoelectric element row, reaching up to the contact section. Here, in the second piezoelectric element row included in the two piezoelectric element rows and located on the side opposite to the contact section relative to the first piezoelectric element row, the distance from the piezoelectric elements to the contact section is greater than in the first piezoelectric element row; and this makes the voltage drop, occurring when the electric current flows from the second electrode of each of the piezoelectric elements constructing the second piezoelectric element row to the contact section, be great. In view of this, the present teaching provides the conductive wires in the second piezoelectric element row located to be far from the contact section; each of the conductive wires is arranged between two adjacent piezoelectric elements which are adjacent in the first direction among the piezoelectric elements constructing the second piezoelectric element row; and each of the conductive wires is conducted at two locations thereof with the electrode conductive portion. Owing to the presence of the conductive wires, the number of the path, via which the electric current flows between the second electrode of each of the piezoelectric elements in the second piezoelectric element row and the contact section, is increased, thereby making it possible to suppress the voltage drop.

Further, in the first piezoelectric element row located close to the contact section, the drive wires corresponding to the piezoelectric elements constructing the second piezoelectric element row located to be far from the contact section pass between the two adjacent piezoelectric elements which are adjacent in the first direction among the piezoelectric elements constructing the first piezoelectric element row. In contrast, there are unoccupied areas (area in which the drive wires are not arranged) between the piezoelectric elements constructing the second piezoelectric element row, and thus the conductive wires can be easily arranged between the piezoelectric elements constructing the second piezoelectric element row, as compared with the first piezoelectric element row.

BRIEF DESCRIPTION OF THE DRAWINGS

FIGS. 5A to 5D are views depicting production steps of a piezoelectric actuator 23, wherein FIG. 5A depicts a step of forming vibration film 30, FIG. 5B depicts a step of forming a common electrode 42 (lower electrode 31), FIG. 5C depicts a step of forming a piezoelectric layer 32, and FIG. 5D depicts a step of etching of the piezoelectric layer 32.

FIGS. 6A to 6C are views depicting production steps of the piezoelectric actuator 23, wherein FIG. 6A depicts a step of forming an upper electrode 33, FIG. 6B depicts a step of forming a protective film 38, and FIG. 6C depicts a step of forming wires 35 and 52.

DESCRIPTION OF THE EMBODIMENTS

Figure 1:
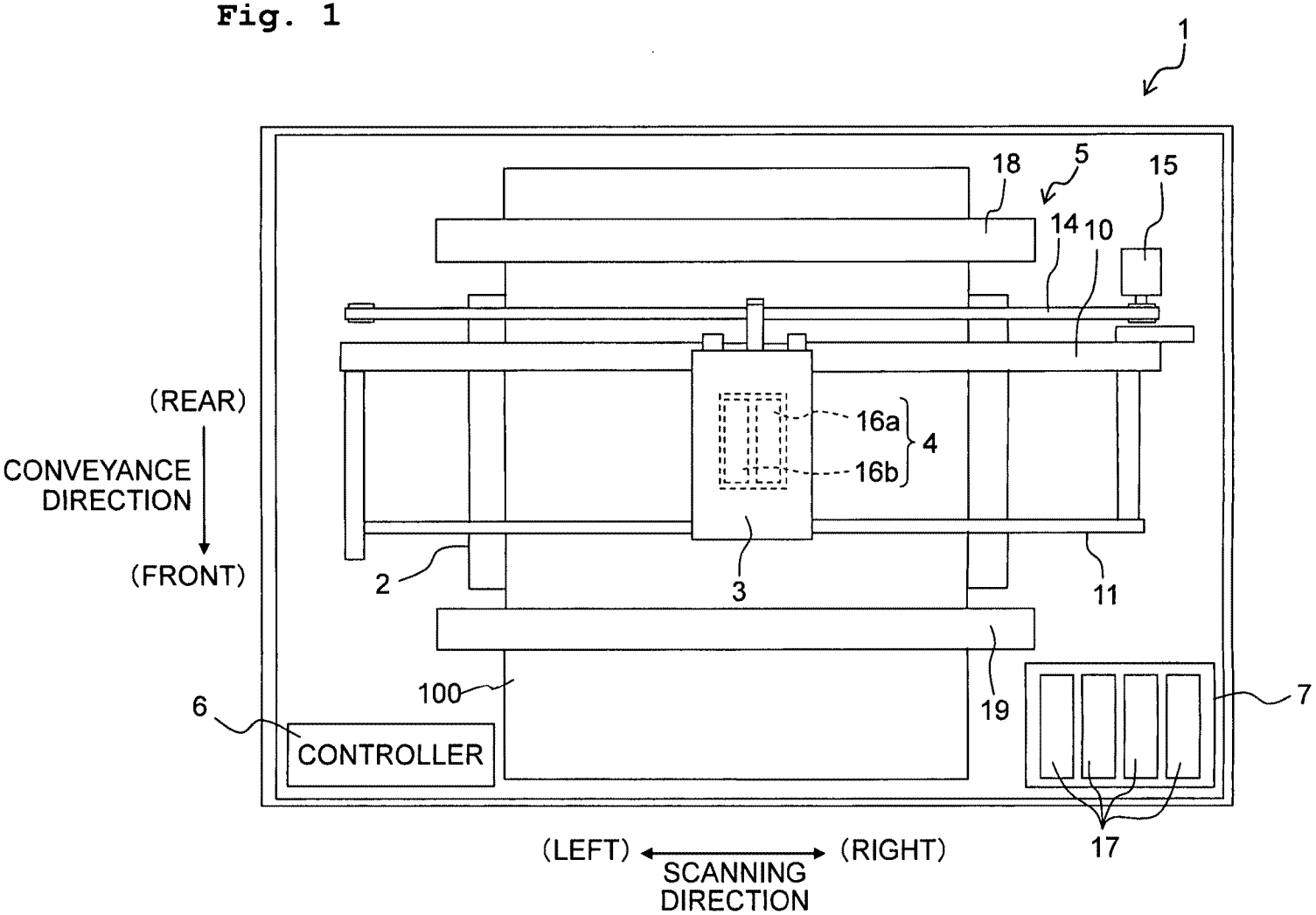
FIG. 1 is a schematic plane view of a printer 1 according to an embodiment of the present teaching.

Next, an embodiment of the present teaching will be described, with reference to the drawings as appropriate. FIG. 1 is a schematic plane view of a printer according to this embodiment. At first, the overall configuration of an ink-jet printer 1 will be explained with reference to FIG. 1. Note that a "scanning direction" as depicted in FIG. 1 is defined as the left-right direction of the printer 1. Further, the upstream side and the downstream side in a "conveyance direction" as depicted in FIG. 1 are defined as the rear (back) side and the front (forward) side, respectively, of the printer 1. Furthermore, a direction orthogonal to the scanning direction and the conveyance direction (direction perpendicular to the sheet surface of FIG. 1) is defined as the up-down direction of the printer 1. Note that the front side of the sheet surface of FIG. 1 is upward, and the other side of the sheet surface of FIG. 1 is downward.

<Schematic Configuration of Printer>

As depicted in FIG. 1, the ink-jet printer 1 is provided with a platen 2, a carriage 3, an ink-jet head 4, a conveyance mechanism 5, a controller 6, etc.

On the upper surface of the platen 2, a recording paper 100 as a recording medium is placed. In a region facing the platen 2, the carriage 3 is configured to be reciprocable in the scanning direction along two guide rails 10, 11. An endless belt 14 is connected to the carriage 3; and the endless belt 14 is driven by a carriage drive motor 15, thereby moving the carriage 3 in the scanning direction.

The ink-jet head 4 is attached to the carriage 3 and moves in the scanning direction together with the carriage 3. The ink-jet head 4 is connected, by non-illustrated tubes, to a cartridge holder 7 on which ink cartridges 17 for four colors (black, yellow, cyan and magenta) are installed. The ink jethead 4 is provided with two head units 16 (16*a*, 16*b*) arranged side by side in the scanning direction. Each of the head units 16 (16*a*, 16*b*) has a plurality of nozzles 24 (see FIGS. 2 to 4) which are formed in the lower surface (the surface on the far side of the sheet surface of FIG. 1) of each of the head units 16, and via which an ink is discharged toward a recording paper P placed on the platen 2. Among the two head units 16 (16*a* and 16*b*), the head unit 16*a* is configured to discharge two color inks that are the black and yellow inks, and the head unit 16*b* is configured to discharge two color inks that are the cyan and magenta inks.

The conveyance mechanism 5 has two conveyance rollers 18, 19 arranged to sandwich the platen 2 therebetween in the conveyance direction. The conveyance mechanism 5 conveys the recording sheet 100 placed on the platen 2 in the conveyance direction by the two conveyance rollers 18, 19.

The controller 6 includes a Read Only Memory (ROM), a Random Access Memory (RAM), an Application Specific Integrated Circuit (ASIC) including various control circuits, etc. The controller 6 performs various processes such as printing onto the recording paper 100, etc., by the ASIC according to programs stored in the ROM. For example, in the printing process, based on a print command input from an external device such as a Personal Computer (PC), the controller 6 controls the head units 16 of the ink-jet head 4, the carriage drive motor 15, etc., so as to print an image, etc. on the recording paper 100. Specifically, the controller 6 alternately performs an ink discharging operation for causing the ink to be discharged while moving the ink-jet head 4 in the scanning direction together with the carriage 3, and a conveyance operation for causing the conveyance rollers 18 and 19 to convey the recording paper 100 by a predetermined amount in the conveyance direction.

<Detailed Configuration of Head Unit of Ink-Jet Head>

Figure 2:
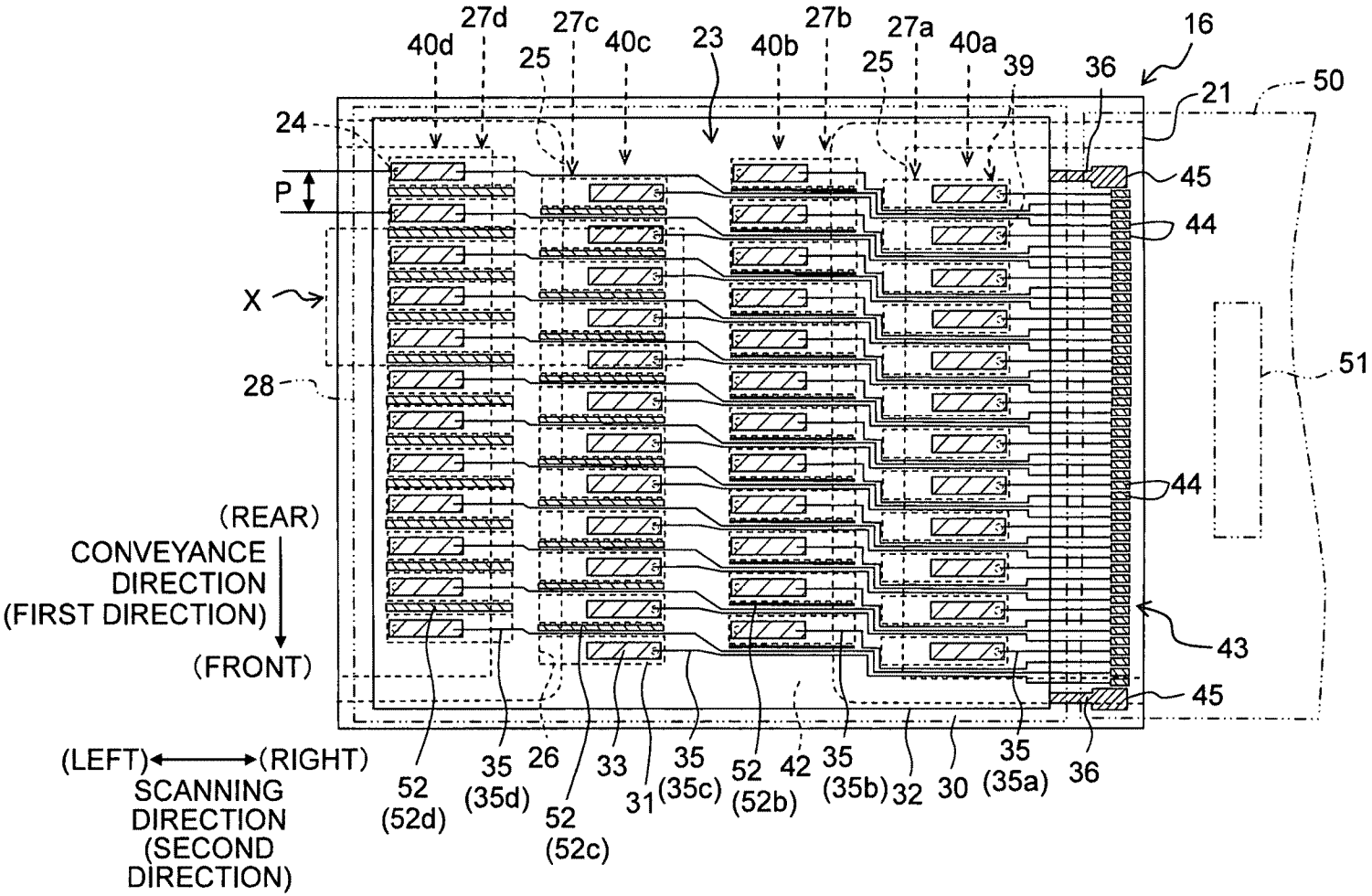
FIG. 2 is a top view of a head unit 16 of an ink-jet head 4.
Figure 3:
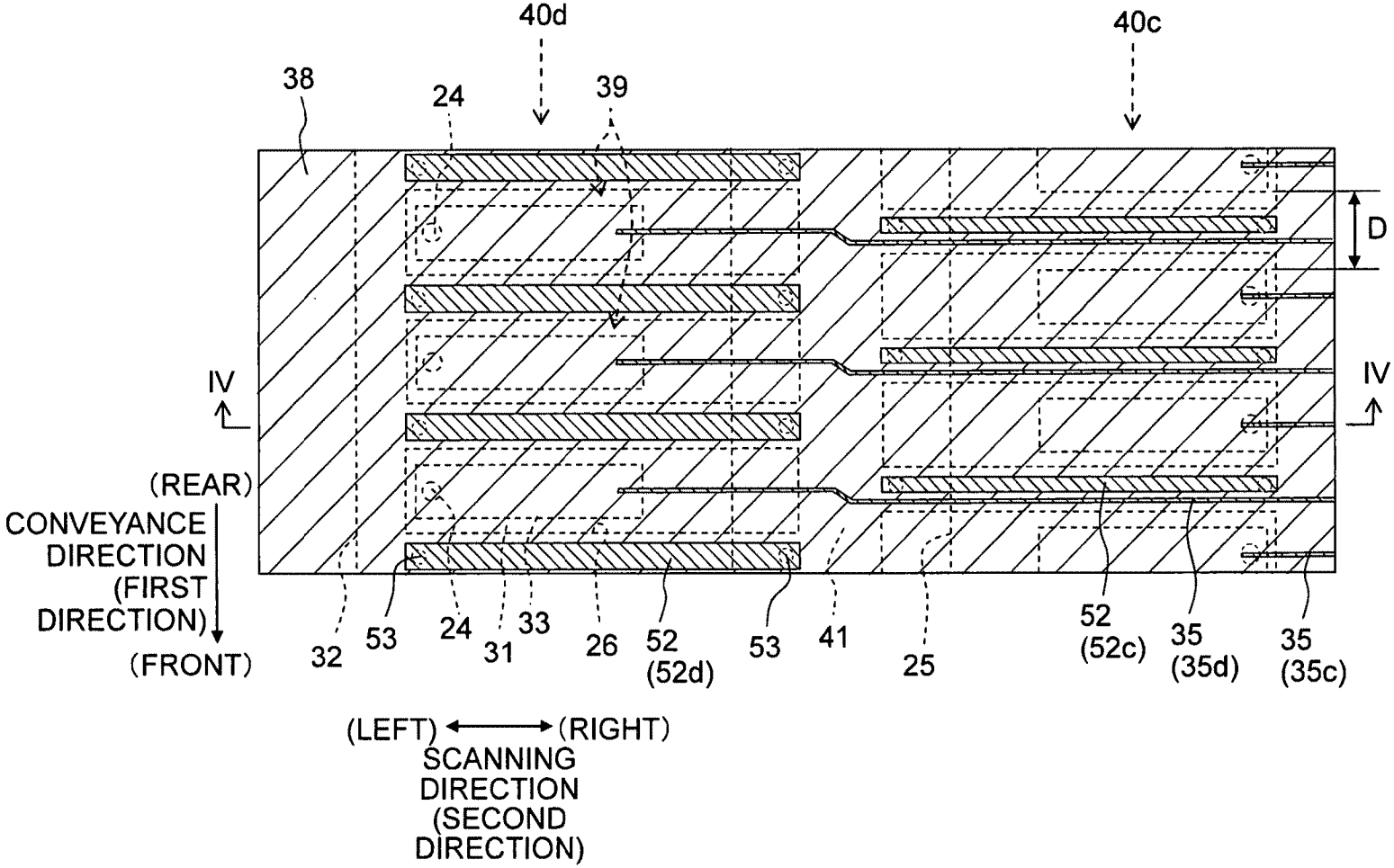
FIG. 3 is an enlarged view of an X-portion in FIG. 2.
Figure 4:
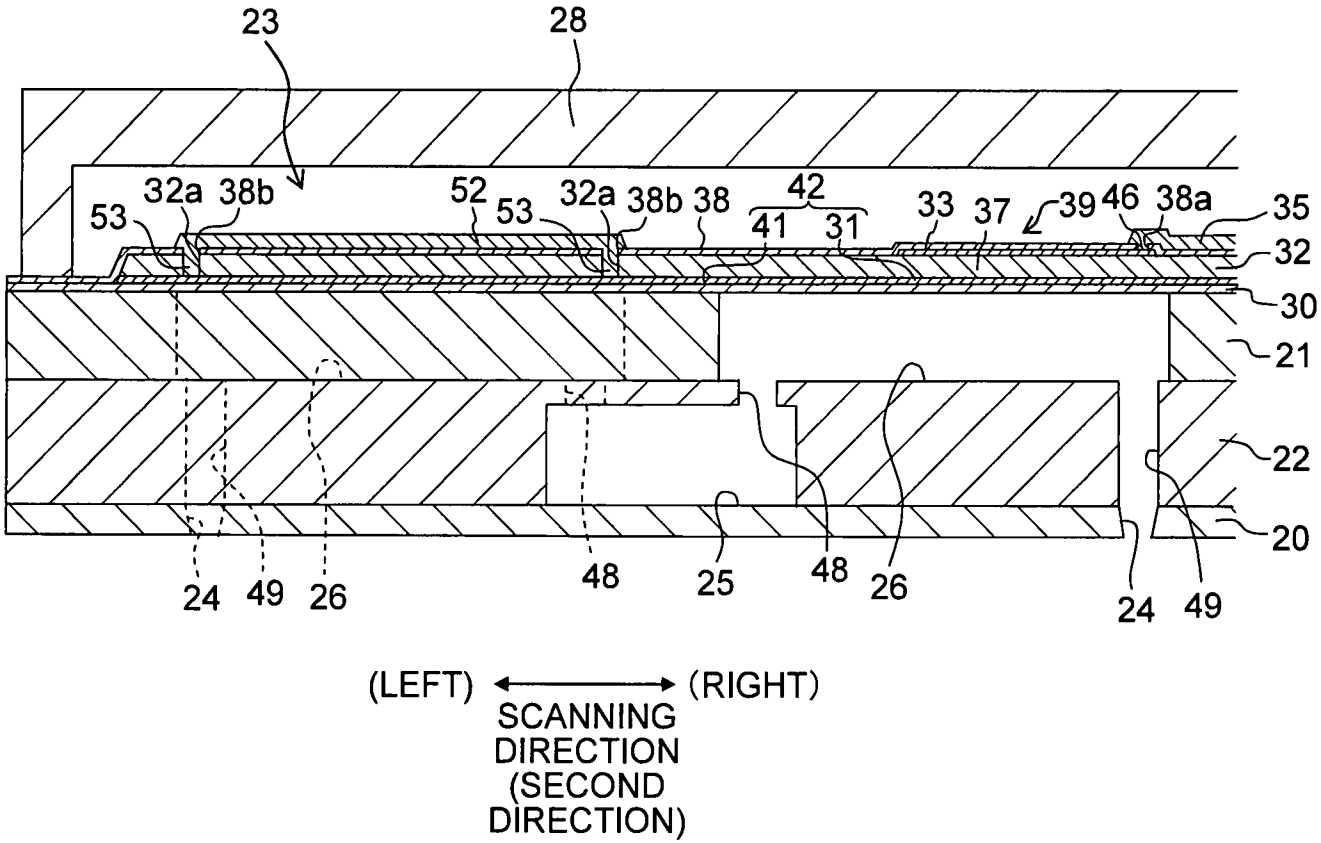
FIG. 4 is a cross-sectional view taken along an IV-IV line in FIG. 3.

Next, the head units 16 of the ink-jet head 4 will be explained. Note that since the two head units 16*a* and 16*b* have a same configuration, the head unit 16*a* which discharges the black and yellow inks will be explained representatively also for the head unit 16*b* discharging the cyan and magenta inks. As depicted in FIGS. 2 to 4, the head unit 16 includes a nozzle plate 20, a first channel substrate 21, a second channel substrate 22, a piezoelectric actuator 23, etc. Note that in FIG. 2, regarding a protective member 28 located above the first channel substrate 21 as depicted in FIG. 4, only its outer shape is depicted by a two-dot chain line for simplification of the drawings. Further in FIG. 2, a protective film 38 covering the first channel substrate 21 entirely as depicted in FIGS. 3 and 4 is omitted so that the configuration of the piezoelectric actuator 23 can be easily understood.

<Nozzle Plate>

The nozzle plate 20 is a plate formed of, for example, silicon, etc. The plurality of nozzles 24 are formed in the nozzle plate 20. As depicted in FIG. 2, the nozzles 24 are aligned in the conveyance direction ("first direction" in the present teaching) to form four nozzle rows arranged side by side in the scanning direction ("second direction" in the present teaching). Two nozzle rows on the right side are nozzle rows which jet the black ink. Positions of the nozzles 24 in one of the two right-side nozzle rows and positions of the nozzles 24 in the other one of the two right-side nozzle rows are deviated or shifted respectively, in the conveyance direction, by a half (P/2) of an arrangement pitch P of the nozzles in each nozzle row. Two nozzle rows on the left side are nozzle rows which jet the yellow ink. As for the two left-side nozzle rows for the yellow ink, similarly to the two right-side nozzle rows, positions of the nozzles 24 in one of the two left-side nozzle rows and positions of the nozzles 24 in the other of the two left-side nozzle rows are deviated, respectively, by P/2 in the conveyance direction.

<Channel Forming Substrate>

Each of the first channel substrate 21 and the second channel substrate 22 is a substrate formed of a silicon single-crystal. In the first channel substrate 21, a plurality of pressure chambers 26 communicating with the plurality of nozzles 24 respectively are formed. The pressure chambers 26 each have a rectangular shape, in a plane view, that is long in the scanning direction. The pressure chambers 26 are aligned in the conveyance direction according to the alignment of the nozzles 24 to form four pressure chamber rows 27 (27*a*, 27*b*, 27*c*, 27*d*) arranged side by side in the scanning direction. Two pressure chamber rows 27*a*, 27*b* on the right side are pressure chamber rows 27 for the black ink, and two pressure chamber rows 27*c*, 27*d* on the left side are pressure chamber rows 27 for the yellow ink. Further, a vibration layer 30 covering the plurality of pressure chambers 26 is formed in the upper surface of the first channel substrate 21. The vibration layer 30 is a layer formed by oxidizing or nitrifying a surface of the silicon substrate.

The second channel substrate 22 is joined to the lower surface of the first channel substrate 21. Further, the above-described nozzle plate 20 is joined to the lower surface of the second channel substrate 22. Two manifolds 25 are formed in the second channel substrate 22 at portions thereof, respectively, at which one of the two manifolds 25 overlaps with the two pressure chambers rows 27*a* and 27*b* on the right side in the up-down direction and the other of the two manifolds 25 overlaps with the two pressure chambers rows 27*c* and 27*d* on the left side in the up-down direction. Each of the manifolds 25 is extended in the conveyance direction as the arranging direction of the pressure chambers 26. Each of the manifolds 25 and the pressure chambers 26 belonging to the two pressure chamber rows 27 corresponding thereto are communicated with a communication hole 48. Further, the two manifolds 25 are connected, via un-illustrated tubes, etc., to two of the ink cartridges 17 (see FIG. 1) attached to the cartridge holder 7 and storing the black and yellow inks, respectively.

The inks supplied from the ink cartridges 17 are supplied to the manifolds 25, and each of the inks is further supplied from one of the manifolds 25 to the pressure chambers 26 corresponding thereto. Further, the second channel substrate 22 is formed also with communication holes 49 via which the pressure chambers 26 formed in the first channel substrate 21 are communicated with the nozzles 26 formed in the nozzle plate 20, respectively. When a discharge energy for ink discharge is applied to the ink inside the pressure chambers 26 by the piezoelectric actuator 23 (as will be described below), droplets of the ink are jetted from the nozzles 24 communicating with the pressure chambers 26 respectively.

<Piezoelectric Actuator>

The piezoelectric actuator 23 applies, to the ink in the pressure chambers 26, the discharge energy for causing the ink to be discharged from the respective nozzles 24. The piezoelectric actuator 23 is provided with a plurality of piezoelectric elements 39 arranged on the upper surface of the vibration film 30 of the first channel substrate 21. The plurality of piezoelectric elements 39 are arranged in the conveyance direction corresponding to the plurality of pressure chambers 26, respectively, and construct four rows of piezoelectric elements (four piezoelectric element rows) 40 (40*a* to 40*d*) which are arranged side by side in the scanning direction. Each of the piezoelectric elements 39 has a piezoelectric portion 37, a lower electrode 31 and an upper electrode 33. Note that a protective member 28 covering the piezoelectric elements 39 of the piezoelectric actuator 23 is joined to the upper surface of the first channel substrate 21.

The configuration of the piezoelectric element 39 will be explained in detail. A common electrode 42 is formed continuously on the upper surface of the vibration film 30 so as to straddle over the plurality of pressure chambers 26. The lower electrode 31 of each of the plurality of piezoelectric elements 39 is a portion of the common electrode 42 facing one of the pressure chambers 26. Further, the lower electrodes 31 of the plurality of piezoelectric elements 39 are communicated with one another via a portion (electrode conductive portion 41), of the common electrode 42, which is arranged between the plurality of pressure chambers 26. Although the material for forming the common electrode 42 (the plurality of lower electrodes 31 and the electrode conductive portion 41) is not particularly limited, the common electrode 42 is formed, for example, of platinum (Pt). Further, the thickness of the common electrode 42 is, for example, 0.1 μm.

A piezoelectric layer 32 is formed on the upper surface of the vibration film 30 so as to cover the common electrode 42. The piezoelectric layer 32 is a film having a rectangular shape in a plane view and formed on the upper surface of the vibration film 30 to span across the four pressure chamber rows 27. Note that a portion, of the piezoelectric layer 32, facing each of the pressure chambers 26 constructs the piezoelectric portion 37 of one of the piezoelectric elements 39. Namely, the piezoelectric layer 32 can be considered also as a film formed by the piezoelectric portions 37, of the plurality of piezoelectric elements 39, which are joined or linked to one another. The piezoelectric layer 32 is made, for example, of a piezoelectric material of which main component is lead zirconate titanate (PZT) that is a mixed crystal of lead titanate and lead zirconate. Alternatively, the piezoelectric layer 32 may be made of a lead-free piezoelectric material that does not contain any lead. The thickness of the piezoelectric layer 32 is, for example, 1 μm.

The plurality of upper electrodes 33 corresponding to the pressure chambers 26, respectively are formed on upper surface of the piezoelectric layer 32. The upper electrodes 33 are individual electrodes provided separately for the pressure chambers 26, respectively. Although the shape of the upper electrodes 33 is not particularly limited, FIG. 3 depicts, as an example, upper electrodes 33 each having a rectangular shape in a plane view smaller than one of the pressure chambers 26. Further, although the material for forming the upper electrodes 33 is not also particularly limited, the upper electrodes 33 are formed, for example, of iridium (Ir). Furthermore, the thickness of the upper electrodes 33 is, for example, 0.1 μm.

Note that the piezoelectric portion 37, of each of the piezoelectric elements 39, which is the portion of the piezoelectric layer 32 sandwiched by the upper electrode 33 and the lower electrode 31 is polarized in a downward direction in a thickness direction of the piezoelectric layer 32, that is, in a direction from the upper electrode 33 toward the lower electrode 31.

As depicted in FIG. 2 and FIG. 4, on the upper surfaces of the vibration film 30 and the piezoelectric layer 32, the protective film 38 formed of an insulating material is formed to cover the plurality of piezoelectric elements 39. The protective film 38 is provided mainly for providing moisture proof for the piezoelectric elements 39. Although the material for forming the protective film 38 is not particularly limited, the protective film 38 is formed, for example, of silicon nitride, silicon dioxide, alumina, etc. Note that the protective film 38 may be configured to cover only a portion of each of the piezoelectric elements 39. For example, it is allowable to form openings via which the upper electrodes 33 are exposed in the protective film 38 such that the upper electrodes 33 are not covered by the protective film 38.

A plurality of drive wires 35 corresponding to the plurality of piezoelectric elements 39, respectively, are formed in the upper surface of the protective film 38. One end portions of the respective drive wires 35 are formed so as to ride up on the upper electrodes 33, respectively. Through holes 38*a* are formed in the protective film 38 at portions overlapping with the one end portions of the drive wires 35, respectively. The drive wires 35 and the upper electrodes 33 are conducted by conductive portions 46 which are formed of a conductive material, arranged inside the through holes 38*a*, respectively, and which are provided to penetrate through the protective film 38. The drive wires 35 each of which is connected to the upper electrode 33 of one of the piezoelectric elements 39 are extended rightward on the upper surface of the protective film 38.

In this embodiment, as depicted in FIGS. 2 and 3, all of the plurality of drive wires 35 each of which is connected to the upper electrode 33 of one of the piezoelectric elements 39 are extended rightward from the upper electrodes 33 corresponding thereto, respectively. With this, each of drive wires 35, included in the plurality of drive wires 35 and drawn from the upper electrode 33 in one of three piezoelectric element rows 40 on the left side, is extended rightward while passing through spaces between two piezoelectric elements 39 belonging to another piezoelectric element row 40 which are located on the right side thereof. For example, as depicted in FIG. 2, three drive wires 35*b* to 35*d* are arranged between two piezoelectric elements 39 which are adjacent in the conveyance direction and which belong to the piezoelectric element row 40*a* located rightmost among the four piezoelectric element rows 40*a* to 40*d*, the three drive wires 35*b* to 35*d* corresponding to the three piezoelectric element rows 40*b* to 40*d*, respectively, which are located on the left side of the piezoelectric element row 40*a*. Note that although the material for forming the drive wires 35 is not particularly limited, it is possible to use gold (Au) or an aluminum-based material (for example, Al—Cu alloy) having a low electric resistivity. The electric resistivity of gold is $2.2\times10^{-8}\Omega$m, the electric resistivity of aluminum is $2.7\times10^{-8}\Omega$m, and the electric resistivity of copper is $1.7\times10^{-8}\Omega$m. On the other hand, the electric resistivity of platinum as the material forming the common electrode 42 is $1.0\times10^{-7}\Omega$m. Note that, however, aluminum is a material easily causing the migration than gold. Accordingly, in a case that the drive wires 35 are formed of aluminum, it is preferable that the drive wires 35 are covered by an insulating film for preventing the migration. Further, the thickness of the drive wires 35 is, for example, 1 μm.

As depicted in FIG. 2, a contact section 43 to which a COF 50 as a wiring member is joined is provided on the upper surface of the vibration film 30 of the first channel substrate 21, at a right end portion of the vibration film 30. A plurality of drive contact portions 44 and two ground contact portions 45 which are arranged side by side in the conveyance direction are disposed in the contact section 43. The drive wires 35 each of which is connected to the upper electrode 33 of one of the plurality of piezoelectric elements 39 are connected to the drive contact portions 44, respectively, arranged in the contact section 43. Further, the common electrode 42 including the plurality of lower electrodes 31 is connected to the two ground contact portions 45 via wires 36.

As depicted in FIGS. 2 to 4, the COF 50 is joined to the contact section 43, and the plurality of drive contact portions 44 arranged in the contact section 43 and a plurality of signal lines (omitted in the drawings) formed in the COF 50 are electrically connected to each other. Further, the two ground contact portions 45 arranged in the contact section 43 are connected to ground wires (omitted in the drawings) formed in the COF 50. Further, although omitted in the drawings, the COF 50 is connected also with the controller 6 (see FIG. 1) of the printer 1.

As depicted in FIG. 2, a driver IC 51 is mounted on the COF 50. The driver IC 51 generates, based on a control signal transmitted from the controller 6, a drive signal for driving the respective piezoelectric elements 39 and outputs the drive signal. The drive signal output from the driver IC 51 is input to the drive contact portions 44 via the signal lines of the COF 51, and is further supplied to the upper electrodes 33 via the drive wires 35, respectively. When the drive signal is supplied to a certain upper electrode 33, the electric potential of the certain upper electrode 33 is changed between a predetermined driving potential and the ground potential. Further, owing to the connection of the ground contact portions 45 to the ground wires of the COF 50, the lower electrodes 31 connected to the ground contact portions 45 are always maintained at the ground potential. The contact section 43 may be connected to the driver IC 51 directly without the FPC.

An operation of each of the piezoelectric elements 39 when the drive signal is supplied from the driver IC 51 will be explained. In a state in which the drive signal is not supplied, the potential of the upper electrodes 33 of the piezoelectric elements 39 is the ground potential and is equal to the potential of the lower electrodes 31. From this state, when the drive signal is supplied to the upper electrode 33 of certain one of the piezoelectric elements 39 and the drive potential is applied to the upper electrode 33, an electric field parallel to the thickness direction of the piezoelectric portion 37 acts on the piezoelectric portion 37 due to a potential difference between the upper electrode 33 and the lower electrode 31. Here, since the polarization direction of the piezoelectric portion 37 is the same as the direction of the electric field, the piezoelectric portion 37 elongates or expands in the thickness direction as its polarization direction and contracts in a planar direction of the piezoelectric portion 37. In accordance with the contraction deformation of the piezoelectric portion 37, a portion of the vibration film 30 corresponding to the piezoelectric portion 37 bend so as to bulge or project toward a certain pressure chamber 26 included in the plurality of pressure chambers 26 and corresponding to the piezoelectric portion 37. Consequently, the volume of the certain pressure chamber 26 is reduced and a pressure wave is generated inside the certain pressure chamber 26, thereby discharging a droplet of the ink from a certain nozzle 24 included in the plurality of nozzles 24 and communicating with the certain pressure chamber 26.

In the embodiment, the plurality of piezoelectric elements 39 constructs the four piezoelectric element rows 40*a* to 40*d* which are arranged side by side in the scanning direction. Further, the common electrode 42 including the lower electrodes 31 of the piezoelectric elements 39 is connected to the ground contact portions 45 of the contact section 43 located at the right end portion of the first channel substrate 21. In this configuration, the distance between the lower electrodes 31 of the piezoelectric elements 39 and the ground contact portions 45 of the contact section 43 is different among the four piezoelectric element rows 40*a* to 40*d*. In the piezoelectric element row 40*d* located at a position far from the contact section 43, the distance between the lower electrodes 31 of the respective piezoelectric elements 39 and the ground contact portions 45 of the contact section 43 is greatest among the four piezoelectric element rows 40*a* to 40*d*, and thus the electric resistance is greatest in the piezoelectric element row 40*d*. Accordingly, when the piezoelectric elements 39 are driven, the voltage drop occurring when the electric current flows from the lower electrodes 31 toward the ground contact portions 45 becomes great. In particular, when the ink is made to be discharged from a large number of the nozzle 24 at the same time, a large number of the piezoelectric element 39 is driven at the same time. Consequently, the voltage drop at the common electrode 42 becomes relatively large, which in turn reduces the voltage applied to each of the piezoelectric elements 39.

In view of this situation, the thickness of the common electrode 42 can be increased so as to reduce the electric resistance in the common electrode 42, thereby suppressing the above-described voltage drop to be small. However, increasing the thickness of the common electrode 42 (in particular, the lower electrodes 31) hinders the deformation of the piezoelectric portions 37 due to the increased thickness. Further, although platinum (Pt) which hardly affects the alignment of the piezoelectric layer 32 is suitable as the material for the common electrode 42, platinum is an expensive material. Thus, also from the viewpoint of cost, it is difficult to increase the thickness of the common electrode 42. Note that the term "alignment of the piezoelectric layer 32" means a state in which the directions of the polarization in the piezoelectric layer 32 are aligned.

For the reasons discussed above, in a case that the difference in the extent of voltage drop between the lower electrodes 31 and the ground contact portions 45 is generated among the four piezoelectric element rows 40*a* to 40*d*, depending on the distance from the ground contact portions 45, the voltage substantially applied to the piezoelectric elements 39 is lowered in a piezoelectric element row 40 in which the voltage drop is great among the four piezoelectric element rows 40 (40*a* to 40*d*). Namely, the voltage applied to the piezoelectric elements 39 is varied among the four piezoelectric element rows 40*a* to 40*d*. This variation in the applied voltage appears as variation in the discharge characteristic of the nozzles 24 among the four nozzle rows, which in turn leads to deterioration (degradation) of the printing quality. In view of this situation, the present embodiment adopts the following configuration for the purpose of suppressing the voltage drop between the ground contact portions 45 of the contact section 43 and the lower electrodes 31 of the piezoelectric elements 39 constructing a piezoelectric element row 40, among the four piezoelectric element rows 40 (40*a* to 40*d*), which is far from the contact section 43.

As depicted in FIGS. 2 to 4, in each of the three piezoelectric element rows 40*b* to 40*d* which are included in the four piezoelectric element rows 40*a* to 40*d* and which are located on the left side (on the side opposite to the contact section 43), drive wires 52 which are conducted with the common electrode 42 are disposed between the upper electrodes 33 of two piezoelectric elements 39 which are adjacent in the conveyance direction among the piezoelectric elements 39 constructing each of the three piezoelectric element rows 40*b* to 40*d*.

The conductive wires 52 are formed of a conductive material (gold, aluminum-based material, etc.) which is same as the material for forming the drive wires 35, and are arranged on the upper surface of the protective film 38 covering the plurality of piezoelectric elements 39, in a similar manner regarding the above-described drive wires 35. Namely, the conductive wires 52 are arranged while overlapping with the common electrode 42, while sandwiching the piezoelectric layer 32 and the protective film 38 between the conductive wires 52 and the common electrode 42. Further, in each of the three piezoelectric element rows 40*b* to 40*d*, the conductive wires 52 are each extended in the scanning direction between the adjacent two piezoelectric elements 39.

Note that the length in the scanning direction of the conductive wires 52 is longer than the length in the scanning direction of the upper electrodes 33 of the two adjacent piezoelectric elements 39. More specifically, the length in the scanning direction of the conductive wires 52 is substantially same as the length in the scanning direction of the pressure chambers 26. Further, the thickness of the conductive wires 52 is same as the thickness of the drive wires 35 and is greater than the thickness of the common electrode 42. For example, in a case that the thickness of the common electrode 42 is 0.1 μm, the thickness of the conductive wire 52 is 1.0 μm, same as the thickness of the drive wires 35.

By arranging the conductive bodies such as the drive wires 35, the conductive wires 52, etc. around the piezoelectric elements 39, the residual stress generating in the piezoelectric elements 39 due to the formation of the respective films and/or the patterning of the piezoelectric layer 32, etc., is changed. From the viewpoint of suppressing the variation of the residual stress among the plurality of piezoelectric elements 39 to be small, the thickness of the conductive wires 52 is made to be same as the thickness of the drive wires 35. Further, for the similar reason, the conductive wires 52 are formed of a conductive material which is same as that forming the drive wires 35.

As depicted in FIGS. 3 and 4, two through holes 32*a* are formed in the piezoelectric layer 32 at portions overlapping with both end portions of each of the conductive wires 52. Further, two through holes 38*b* are also formed in the protective film 38 at portions overlapping with both end portions of each of the conductive wires 52. By charging the conductive material forming the conductive wires 52 inside of the through holes 32*a* of the piezoelectric layer 32 and into the through holes 38*b* of the protective film 38, conductive portions 53 penetrating through the piezoelectric layer 32 and the protective film 38 are arranged. Further, the both end portions of each of the conductive wires 52 are connected to the electrode conductive portion 41 of the common electrode 42 via the two conductive portions 53, respectively. Note that the positions of the two conductive portions 53 allowing each of the conductive wires 52 to be conducted with the common electrode 42 are not limited to the both end portions of the conductive wire 52. However, in a case that the conductive portions 53 are located at positions close to a central portion of the conductive wire 53, the length of the conductive wire 52 which functions as a path allowing a portion of the electric current flowing through the common electrode 42 to flow therethrough is substantially shortened. Therefore, the two conductive portions 53 are preferably located at the both end portions of the conductive wire 52.

In the piezoelectric element row 40*b* positioned second from the right, a conductive wire 52*b*, and two drive wires 35*c* and 35*d* which are drawn from the piezoelectric element rows 40*c* and 40*d*, respectively, are arranged between two adjacent piezoelectric elements 39. Further, in the piezoelectric element row 40*c* positioned third from the right, a conductive wire 52*c*, and a drive wire 35*d* which is drawn from the piezoelectric element row 40*d* are arranged between two adjacent piezoelectric elements 39. Note that in the piezoelectric element rows 40*b* and 40*c*, the conductive wires 52 are arranged on the rear side relative to the drive wires 35. Further, in the piezoelectric element row 40*d* located on the leftmost side, only a conductive wire 52*d* is arranged between two adjacent piezoelectric elements 39.

As described above, in the piezoelectric element rows 40 (40*b* to 40*d*) which are located at the positions far from the contact section 43 in the scanning direction, the conductive wires 52 conducted with the common electrode 42 are arranged between the adjacent piezoelectric elements 39. Accordingly, a number of the path via which the electric current flows is increased between the ground contact portions 45 of the contact section 43 and the lower electrodes 31 of the piezoelectric elements 39 constructing the piezoelectric element rows 40*b* to 40*d*. With this, the electric resistance is substantially lowered between the lower electrodes 31 and the ground contact portions 45. Therefore, in the piezoelectric elements 39 constructing each of the piezoelectric element rows 40*b* to 40*d* which are located at the positions far from the contact section 43, the voltage drop, between the lower electrodes 31 and the ground contact portions 45 of the contact section 43 occurring when the electric current is allowed to flow from the lower electrodes 31 toward the ground contact portions 45, can be suppressed to be small. By suppressing the above-described voltage drop to be small, the variation in the voltage applied to the plurality of piezoelectric elements 39 can be suppressed among the piezoelectric elements 39, and thus the difference in the discharge characteristic among the plurality of nozzles 24 is reduced to be small.

Note that in the piezoelectric element row 40*a* closest to the contact section 43, three drive wires 35*b* to 35*d* corresponding to the remaining three piezoelectric element rows 40*b* to 40*d*, respectively, pass through a space between two piezoelectric elements 39 which are adjacent in the conveyance direction. As compared with this configuration in the piezoelectric element row 40*a*, in the remaining three piezoelectric element rows 40*b* to 40*d*, the number of the drive wire 35 passing through the space between the two piezoelectric elements 39 adjacent in the conveyance direction is smaller. Namely, in the piezoelectric element rows 40*b* to 40*d* which are far from the contact section 43, the area of a region which is vacant and present between two adjacent piezoelectric elements 39 is greater than that in the piezoelectric element row 40*a*. Therefore, the conductive wires 52 can be easily arranged between the two adjacent piezoelectric elements 39.

Further, among the three piezoelectric element rows 40*b* to 40*d* provided with the conductive wires 52, as the distance from the contact section 43 is greater, the electric resistance becomes greater between the lower electrodes 31 of the piezoelectric elements 39 and the ground contact portions 45 of the contact section 43, and the voltage drop also becomes greater. In view of this situation, it is preferable that the electric resistance in the conductive wires 52 disposed in a certain piezoelectric element row 40, which is included in the piezoelectric element rows 40 and of which distance from the contact section 43 is great, is smaller than the electric resistance in the conductive wires 52 disposed in another piezoelectric element row or rows 40 which is/are closer to the contact section 43 than the certain piezoelectric element row 40. Namely, it is preferable that the conductive wire 52 arranged between two adjacent piezoelectric elements 39 either (i) has a greater width, or (ii) is provided in a larger number (the number of the conductive wire 52 is greater), or (iii) is formed of a conductive material with a lower electric resistance, than the drive wire 35.

As an example, in the embodiment, as the distance between the piezoelectric element row 40 and the contact section 43 is greater, the width in the conveyance direction of the conductive wires 52 arranged in the piezoelectric element row 40 is greater. Namely, among the piezoelectric element rows 40*b* to 40*d*, the conductive wires 52 in the piezoelectric element row 40*d* have the greatest width in the conveyance direction, and the conductive wires 52 in the piezoelectric element row 40*c* have the second greatest width in the conveyance direction, and the conductive wires 52 in the piezoelectric element row 40*b* have the smallest width in the conveyance direction.

A specific example of the width of the conductive wires 52 is as follows. In a case that a distance "D" (see FIG. 3) between two upper electrodes 33 which are adjacent in the conveyance direction is in a range of 15 μm to 20 μm and that the width in the scanning direction of the drive wires 35 is in a range of 2 μm to 3 μm, the width of the narrowest conductive wires 52*b* is preferably in a range of 2 μm to 3 μm, same as that for the drive wires 35. Further, the width of the conductive wires 52*c* is preferably a range of 4 μm to 6 μm that is twice the width of the conductive wires 52*b*. Furthermore, the width of the conductive wires 52*d* is preferably a range of 6 μm to 9 μm that is three times the width of the conductive wires 52*b*.

The relationship regarding the width of the conductive wires 52 among the plurality of piezoelectric element rows 40 can be generalized by the following formula, provided that the width of the conductive wires 52 located in a n-th row from the contact section 43 is "Wn", $$Wn=k\times(n-1)$$

(in the formula, "k" is a constant).

Further, the electric resistance of the conductive wires 52 themselves is preferably small as much as possible. Accordingly, the conductive wires 52 are formed of a conductive material of which electric resistance is smaller than that of the material forming the common electrode 42. Specifically, in a case that the common electrode 42 is formed of platinum, the conductive wires 52 may be formed, similarly as the drive wires 35, of gold or aluminum of which electric resistivity is smaller than that of platinum. By using the same conductive material for forming the conductive wires 52 and the drive wires 35, it is possible to form the conductive wires 52 and the drive wires 35 by a same film formation process. Further, as depicted in FIG. 4, the thickness of the conductive wires 52 is made to be greater than the thickness of the common electrode 42.

Furthermore, the length in the scanning direction of the conductive wires 52 is greater than the length in the scanning direction of the upper electrodes 33. Although increasing the length in the scanning direction of the conductive wires 52 does not lower the electric resistance of the conductive wires 52 themselves, this lengthens a section or segment via which the electric current is allowed to flow between the lower electrodes 31 and the ground contact portions 45 of the contact section 43, as a separate path from that regarding the common electrode 42, thereby achieving such an effect that the overall electric resistance between the lower electrodes 31 and the ground contact portions 45 is lowered.

By adopting these configurations, the electric resistance in the area or region from the lower electrodes 31 of the piezoelectric elements 39 constructing the piezoelectric element rows 40*b* to 40*d* to the ground contact portions 45 of the contact section 43 is lowered, thereby making it possible to suppress the voltage drop to be small.

Next, steps for producing the head units 16 of the above-described ink-jet head 4, particularly for producing the piezoelectric actuator 23, will be explained. In this embodiment, the piezoelectric actuator 23 including the plurality of piezoelectric elements 39 is produced by performing film formation and patterning of various films on the vibration film 30 of the first channel substrate 21, in a sequential manner.

Figures 5A, 5B, 5C, 5D:
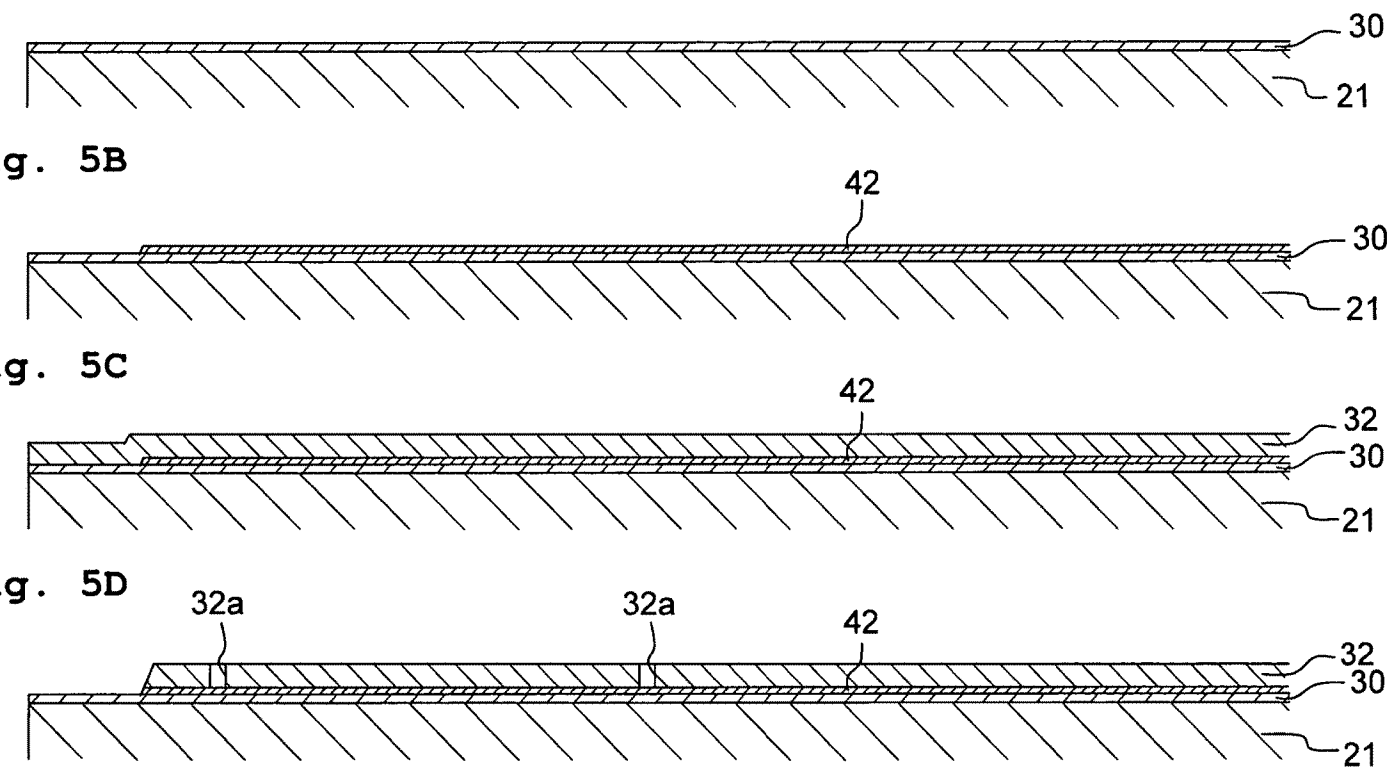

Firstly, as depicted in FIG. 5A, a vibration film 30 is formed with silicon dioxide, etc., on a surface of the first channel substrate 21 by means of thermal oxidation, etc. Next, as depicted in FIG. 5B, a common electrode 42 (lower electrode 31) is formed on the vibration film 30 by performing film formation by means of sputtering, etc., and patterning by means of etching.

Next, a piezoelectric layer 32 is formed on the common electrode 42. Firstly, as depicted in FIG. 5C, the piezoelectric layer 32 is formed on the upper surface of the vibration film 30 by means of the Sol-Gel method, the sputtering method, etc., so that the piezoelectric layer 32 covers the common electrode 42. Next, as depicted in FIG. 5D, the piezoelectric layer 32 is patterned by dry etching. In this situation, through holes 32*a* for allowing conductive wires 52 (to be described later on) to be conducted with the common electrode 42 are formed in portions, of the piezoelectric layer 32, corresponding to three piezoelectric element rows 40*b* to 40*d*.

Figure 6A:
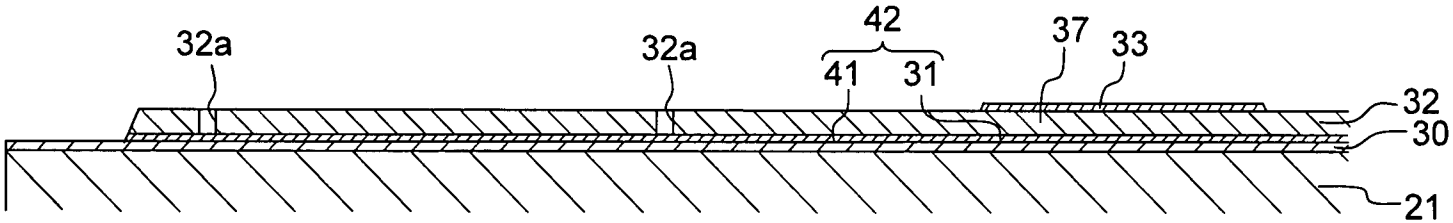

As depicted in FIG. 6A, a plurality of upper electrodes 33 corresponding to a plurality of pressure chambers 26, respectively, are formed on the upper surface of the piezoelectric layer 32. Specifically, a conductive film is formed by means of the sputtering, etc., and then the conductive film is patterned by the etching, thereby forming the upper electrodes 33.

Figure 6B:
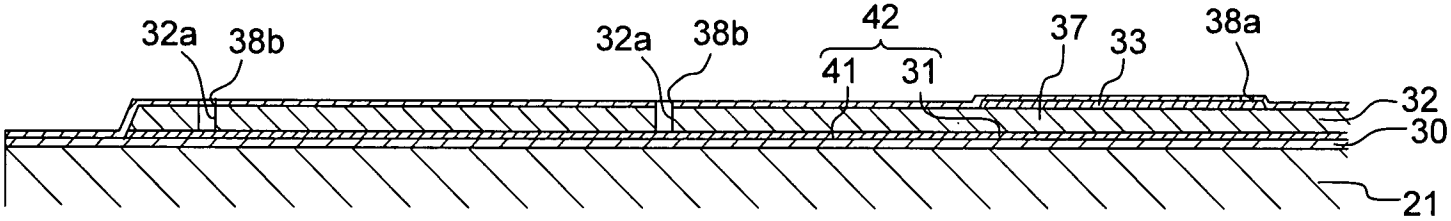

Next, as depicted in FIG. 6B, a protective film 38 is formed on the upper surface of the vibration film 30 so that the protective film 38 covers portions, of the piezoelectric layer 32, which are to be the plurality of piezoelectric elements 39. At first, the protective film 38 is formed on the upper surface of the vibration film 30 by means of a film formation method such as the sputtering, etc. so that the protective film 38 covers the piezoelectric layer 32. Next, through holes 38*a* and through holes 38*b* are formed by means by the etching in the protective film 38 by removing, respectively, portions of the protective film 38 each overlapping with a right end portion of one of the upper electrodes 33 and portions of the protective film 38 each overlapping with one of the through holes 32*a* of the piezoelectric layer 32.

Figure 6C:
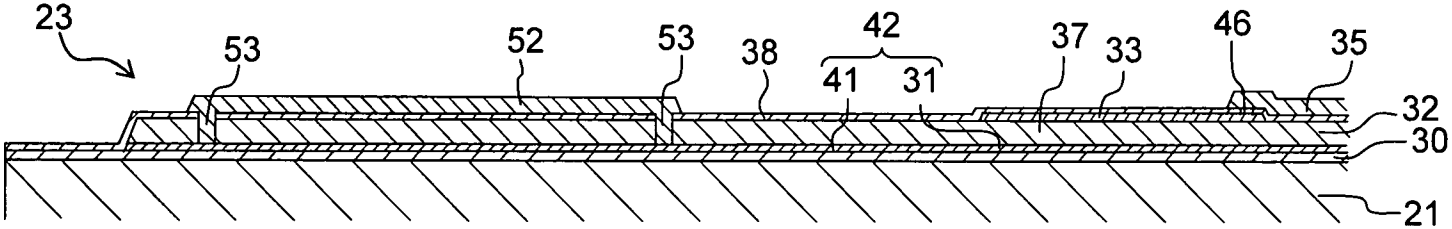

Next, as depicted in FIG. 6C, drive wires 35 and conductive wires 52 which are formed of a material such as gold, aluminum, etc. are formed on the upper surface of the protective film 38, by means of a same film formation process (wire forming step). Although the wire forming process is not particularly limited, a suitable method is different depending on a material to be used. For example, in a case that the wires are to be formed of gold, the drive wires 35 and the conductive wires 52 are preferably formed by forming a mask firstly with photoresist so that the mask partially covers the piezoelectric layer 32, and then by forming a film of gold with the plating method in an area of the piezoelectric layer 32 which is not covered by the mask. On the other hand, in a case that the wires are to be formed of an aluminum-based material, at first, a film of the aluminum-based material is formed on the entire upper surface of the protective film 38 by means of the sputtering, etc. Then, a portion of the film is partially removed by means of wet etching, thereby forming the drive wires 35 and the conductive wires 52 at the same time.

In such a manner, the conductive wires 52 connected to the common electrode 42 are formed by the same film formation process as forming the plurality of drive wires 35 corresponding to the plurality of piezoelectric elements 39, respectively. Thus, any additional special process for forming the conductive wires 52 is required. Further, since the common electrode 42 and the drive wires 35 can be electrically separated or divided by the protective film 38, the routing of the electric current can be performed easily with respect to the common electrode 42, thereby making it possible to further suppress the voltage drop in the common electrode 42.

After forming the piezoelectric actuator 23 on the vibration film 30 as described above, a protective member 28 (see FIG. 4) is joined to the first channel substrate 21 so as to cover the plurality of piezoelectric elements 39 of the piezoelectric actuator 23. Further, a plurality of pressure chambers 26 are formed in the first channel substrate 21 by the etching. Furthermore, a second channel substrate 22 and a nozzle plate 20 formed with nozzles 24 are joined to the first channel substrate 21, thereby completing the production of the head unit 16.

In the embodiment as explained above, the ink-jet head 4 corresponds to the "liquid discharging apparatus" of the present teaching; the first channel substrate 21 corresponds to the "substrate" of the present teaching; the piezoelectric element row 40*a* corresponds to the "first piezoelectric element row" of the present teaching; the piezoelectric element row 40*b* corresponds to the "second piezoelectric element row" of the present teaching; and the piezoelectric element rows 40*c* and 40*d* correspond to the "third piezoelectric element row" of the present teaching; the lower electrode 31 corresponds to the "first electrode " of the present teaching; the upper electrode 33 corresponds to the "second electrode" of the present teaching; the protective film 38 corresponds to the "insulating film" of the present teaching; the conductive portion 46 corresponds to the "first conductive portion" of the present teaching; and the conductive portion 53 corresponds to the "second conductive portion" of the present teaching.

Next, an explanation will be given about modifications in which various changes are made to the above-described embodiment. However, any parts or components constructed in the similar manner to that in the above-described embodiment are designated with same reference numerals, and description thereof is omitted as appropriate.

Figure 7:
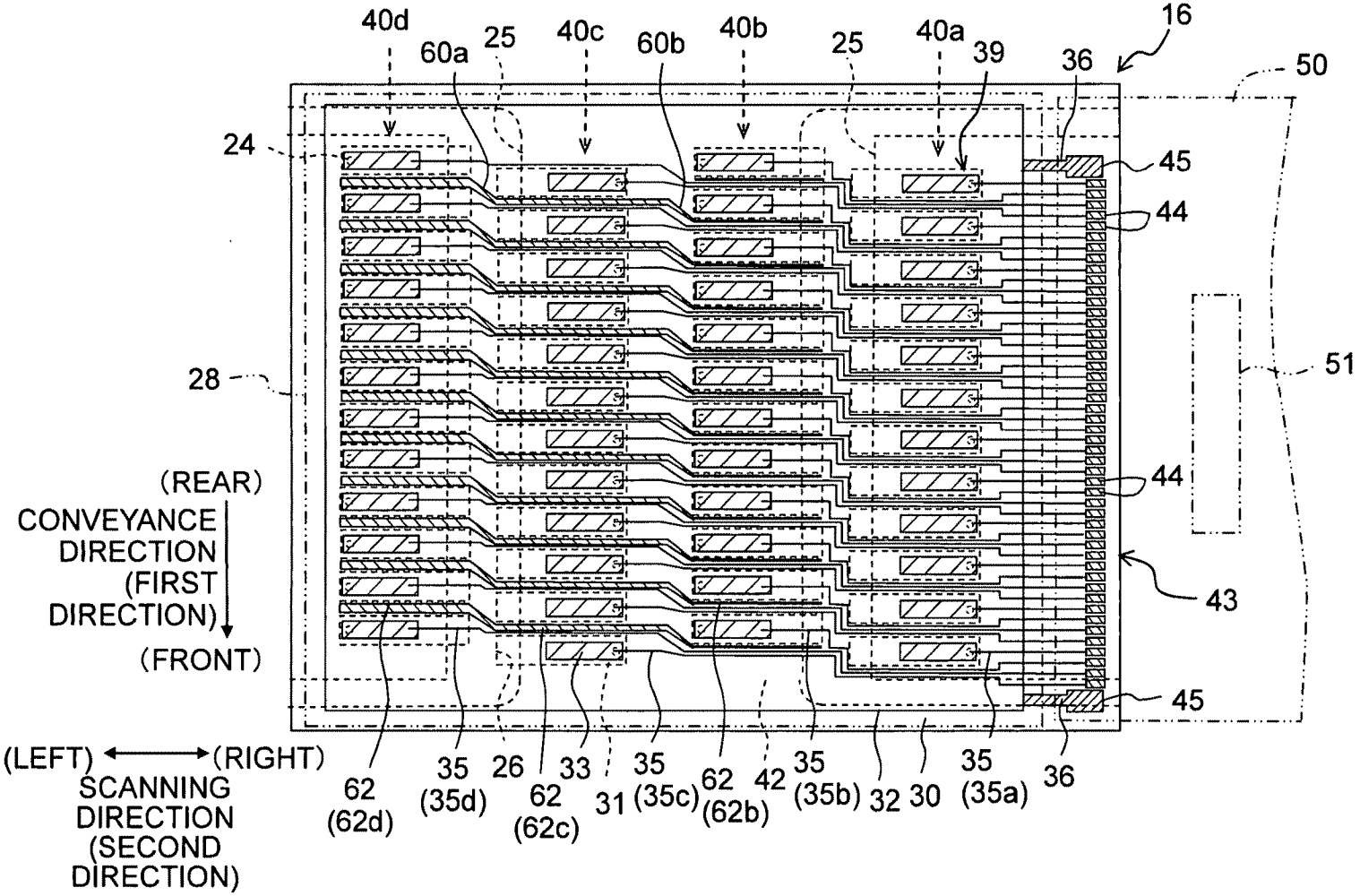
FIG. 7 is a top view of a head unit 16 according to a modification.

As depicted in FIG. 7, it is allowable that conductive wires 62*b* to 62*d* provided with respect to three piezoelectric element rows 40*b* to 40*d* on the left side, respectively, are conducted with one another via connecting portions 60*a* and 60*b* arranged respectively between adjacent rows among the three piezoelectric element rows 40*b* to 40*d* on the left side. More specifically, the conductive wires 62*c* provided on the piezoelectric element row 40*c* and the conductive wires 62*d* provided on the piezoelectric element row 40*d* are conducted with each other via the connecting portions 60*a*, respectively, which are extended between the piezoelectric element rows 40*c* and 40*d* in a direction intersecting the scanning direction. Further, the conductive wires 62*b* provided on the piezoelectric element row 40*b* and the conductive wires 62*c* provided on the piezoelectric element row 40*c* are conducted with each other via the connecting portions 60*b*, respectively, which are extended between the piezoelectric element rows 40*b* and 40*c* in the direction intersecting the scanning direction. Namely, single conductive wires or continued conductive wires extending to span across the three piezoelectric element rows 40*b* to 40*d* is constructed of the conductive wires 62*b* to 62*d* and the connecting portions 60*a* and 60*b*.

According to this configuration, a section or segment, via which the electric current is allowed to flow as a separate path from that regarding the common electrode 42, becomes long between the lower electrodes 31 of the piezoelectric elements 39 constructing the piezoelectric element rows 40*c* and 40 far from the contacting section 43 and the ground contact portions 45 of the contact section 43. Therefore, the electric resistance is small between the contact section 43 and the piezoelectric elements 39 constructing the piezoelectric element rows 40*c* and 40*d*, thereby suppressing the voltage drop to be further small.

In the embodiment, as the distance between the piezoelectric element row 40 and the contact section 43 is greater, the width in the conveyance direction of the conductive wires 52 arranged in the piezoelectric element row 40 is greater, from the viewpoint of reducing the electric resistance to be small in the conductive wires 52 corresponding to the piezoelectric element row 40 far from the contact section 43. On the other hand, it is allowable that as the distance between the piezoelectric element row 40 and the contact section 43 is greater, the conductive wire 52 arranged between adjacent two piezoelectric elements 39 may be provided in a greater number (the number of the conductive wire 52 arranged between adjacent two piezoelectric elements 39 may be greater).

Figure 8:
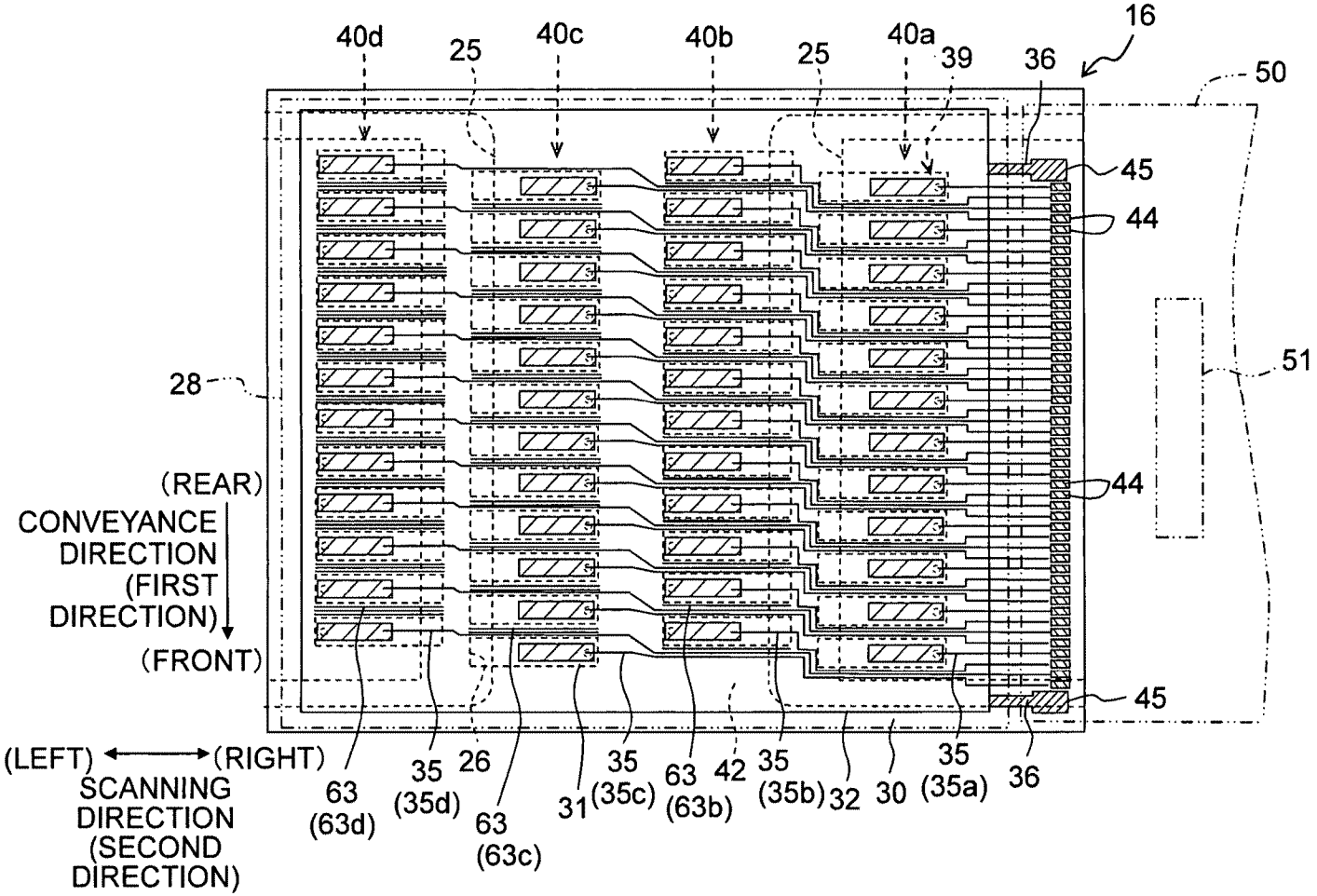
FIG. 8 is a top view of a head unit 16 according to another modification.

As depicted in FIG. 8, regarding three piezoelectric element rows 40*b* to 40*d*, as the distance between the piezoelectric element row 40 and the contact section 43 is greater, a conductive wire 63 arranged between adjacent two piezoelectric elements 39 constructing the piezoelectric element row 40 is provided in a greater number. Specifically, the number of a conductive wire 63*d* provided in the piezoelectric element 40*d* is greatest; three pieces of the conductive wire 63*d* are arranged between two adjacent piezoelectric elements 39 in the piezoelectric element row 40*d*. Further, the number of a conductive wire 63*c* provided in the piezoelectric element 40*c* is second greatest; two pieces of the conductive wire 63*c* are arranged between two adjacent piezoelectric elements 39 in the piezoelectric element row 40*c*. The number of a conductive wire 63*b* provided in the piezoelectric element 40*b* is smallest; only one piece of the conductive wire 63*d* is arranged between two adjacent piezoelectric elements 39 in the piezoelectric element row 40*b*.

In such a manner, the conductive wires 63 provided with respect to a certain piezoelectric element row(s) 40 of which distance from the contact section 43 is (are) great are provided in a greater number than that in another (other) piezoelectric element row(s) 40 closer to the contact section 43 than the certain piezoelectric element row(s). Accordingly, the electric resistance is small between the lower electrodes 31, of the piezoelectric elements 39 constructing the piezoelectric element row(s) 40 far from the contact section 43, and the ground contact portions 45 of the contact section 43, thereby suppressing the voltage drop to be small between the lower electrodes 31 and the ground contact portions 45.

Further, FIG. 8 depicts a configuration wherein the total of the number of the drive wires 35 and the number of the conductive wires 63 which are arranged between two piezoelectric elements 39 adjacent in the conveyance direction is same among the four piezoelectric element rows 40*a* to 40*d*. Specifically, in the piezoelectric element row 40*a*, three pieces of the drive wire 35 are arranged between two piezoelectric elements 39 adjacent in the scanning direction. In the piezoelectric element row 40*b*, two pieces of the drive wire 35 and one piece of the conductive wire 63 are arranged between two piezoelectric elements 39 adjacent in the scanning direction. In the piezoelectric element row 40*c*, one piece of the drive wire 35 and two pieces of the conductive wire 63 are arranged between two piezoelectric elements 39 adjacent in the scanning direction. Further, in the piezoelectric element row 40*d*, three pieces of the conductive wire 63 are arranged between two piezoelectric elements 39 adjacent in the scanning direction. Namely, the conditions such as the amount of the conductive bodies arranged around each of the piezoelectric elements 39, the arrangement location of the conductive bodies, etc., become similar among the piezoelectric elements 93 belonging to the four piezoelectric element rows 40*a* to 40*d*, respectively. With this, it is possible to make the stress condition such as the residual stress generating in the piezoelectric elements 39 due to the formation of the respective films and/or the patterning of the piezoelectric layer 32, etc. to be similar among the piezoelectric elements 39 belonging to the four piezoelectric element rows 40*a* to 40*d* respectively, thereby making it possible to suppress the variation of the residual stress among the piezoelectric elements 39 belonging to the four piezoelectric element rows 40*a* to 40*d* respectively to be small as much as possible.

Note that from the viewpoint of further suppressing the variation of the residual stress, it is preferable that the width of the drive wires 35 and the width of the conductive wires 63 arranged between the two adjacent piezoelectric elements 39 are all the same. For example, in a case that the distance between two piezoelectric elements 39 adjacent in the conveyance direction is in a range of 15 μm to 20 μm, the width of the drive wires 35 and the width of the conductive wires 63 are each preferably made to be in a range of 2 μm to 3 μm. Further, it is preferable that the thickness of the drive wires 35 and the thickness of the conductive wires 63 are same.

In order to lower the electric resistance from the ground contact portions 45 of the contact section 43 to the lower electrodes 31 of the piezoelectric elements 39, the conductive wires are preferably formed of a conductive material having a low electric resistivity as much as possible. Accordingly, the conductive wires may be formed of a conductive material of which electric resistivity is lower than that of the drive wires 35. For example, in FIGS. 2 and 3 depicting the above-described embodiment, in a case that the drive wires 35 are formed of an aluminum-based material which is relatively inexpensive, the conductive wires 52 may be formed of gold which is more expensive than the aluminum-based material but has a lower electric resistivity than the aluminum-based material.

Figure 9:
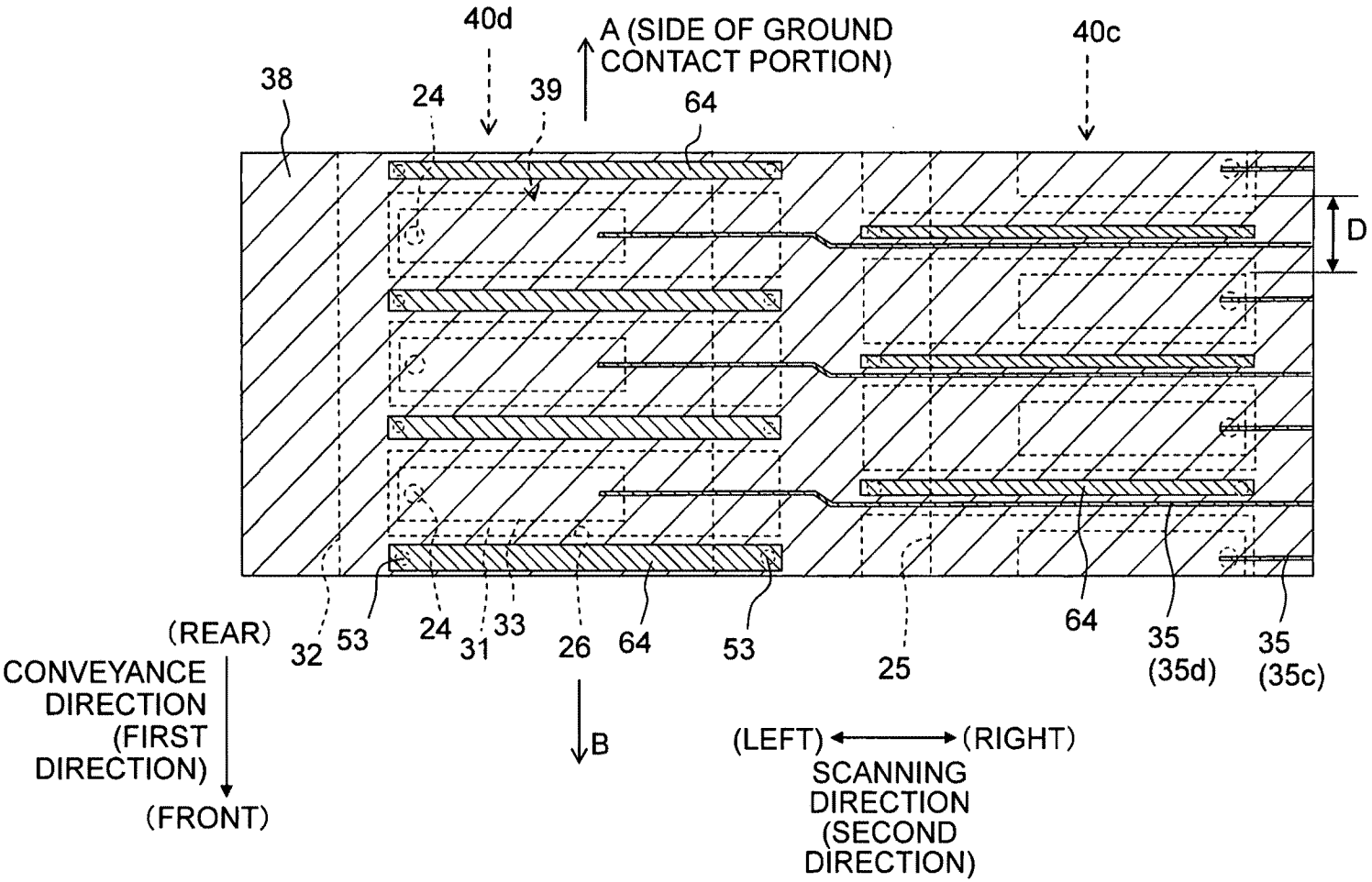
FIG. 9 is a partially enlarged view of a head unit 16 according to another modification.

In the above-described embodiment, the plurality of drive contact portions 44 and the ground contact portions 45 of the contact section 43 are arranged side by side (aligned) in the conveyance direction. Therefore, the distance from the grand contact portions 45 is different among the plurality of piezoelectric elements 39 constructing each of the three piezoelectric element rows 40*b* to 40*d*. In view of this, the widths of the plurality of conductive wires, provided with respect to each of the piezoelectric element rows 40*b* to 40*d*, may be made to be progressively greater in proportion to the distance from the ground contact portion 45. In other words, the plurality of conductive wires provided in each of the three piezoelectric element rows 40*b* to 40*d* may be constructed such that a conductive wire, among the plurality of conductive wires, of which distance from the ground contact portion 45 is greater has a width greater than a width of another conductive wire of which distance from the ground contact portion 45 is shorter. In FIG. 9, an upper portion in the sheet surface indicated by an arrow "A" is a direction approaching closer to the ground contact portion 45 in the conveyance direction, and a lower portion in the sheet surface indicated by an arrow "B" is a direction separating far from the ground contact portion 45 in the conveyance direction. Further, conductive wires 64 provided in each of the piezoelectric element rows 40 are configured such that a conductive wire 64, among the plurality of conductive wires 64, of which distance from the ground contact portion 45 is greater has a width greater than a width of another conductive wire 64 of which distance from the ground contact portion 45 is shorter. Namely, the widths of the conductive wires 64 are made to be progressively greater, as the distance thereof from the ground contact portion 45 in the conveyance direction becomes greater. With this configuration, it is possible to suppress the voltage drop between the lower electrode 31 and the ground contact portion 45 to be small in particular for a piezoelectric element 39 which is included in the plurality of piezoelectric elements 39 constructing one piezoelectric element row 40 and which is located at a position far from the ground contact portion 45 in one piezoelectric element row 40. Note that the drive contact portion 44 in the embodiment corresponds to the "first contact portion" in the present teaching, and the ground contact portion 45 corresponds to the "second contact portion" in the present teaching.

It is not necessarily indispensable that the width and number of the conductive wires arranged between the two piezoelectric elements 39 adjacent in the conveyance direction are made to be different among the three piezoelectric element rows 40*b* to 40*d*, as in the embodiment and the modifications (FIGS. 8, etc.) as described above. Namely, the width and the number of the conductive wires arranged between the two piezoelectric elements 39 adjacent in the conveyance direction are made to be same among the three piezoelectric element rows 40*b* to 40*d*.

In the above-described embodiment, the piezoelectric layer 32 is arranged on the vibration film 30 so as to cover the plurality of pressure chambers 26 as depicted in FIGS. 2 and 3, and the piezoelectric portions 37 of the plurality of piezoelectric elements 39 are linked or joined with one another. Further, the drive wires 35 and the conductive wires 52 are arranged in the piezoelectric layer 32 at portions between the piezoelectric portions 37 of the adjacent piezoelectric elements 39. In contrast to this configuration, it is possible to apply the present teaching also to a case that the piezoelectric portions of the plurality of piezoelectric elements 39 are separated or isolated in the conveyance direction.

Figure 10:
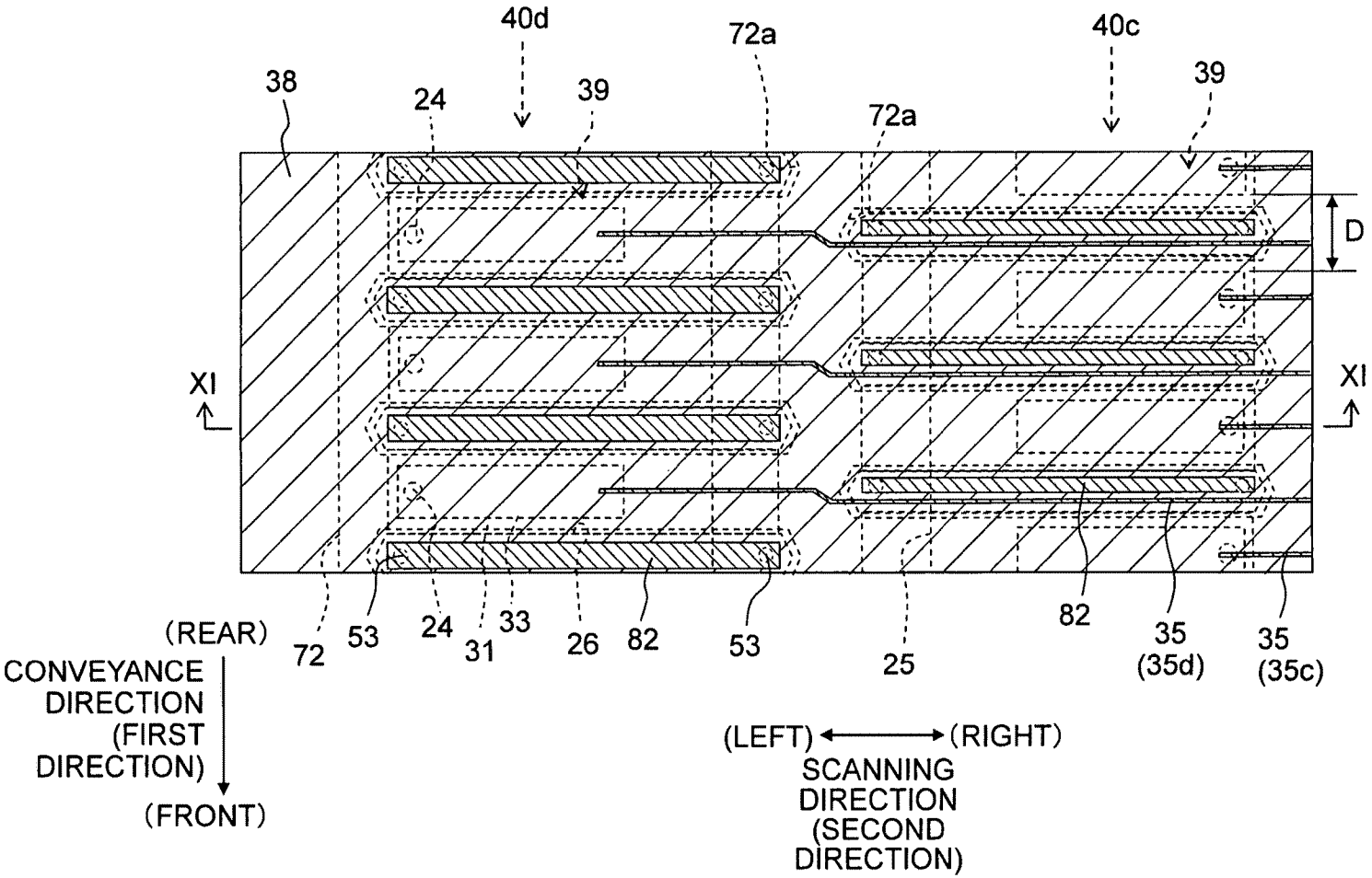
FIG. 10 is a partially enlarged view of a piezoelectric actuator 23 according to another modification.
Figure 11:
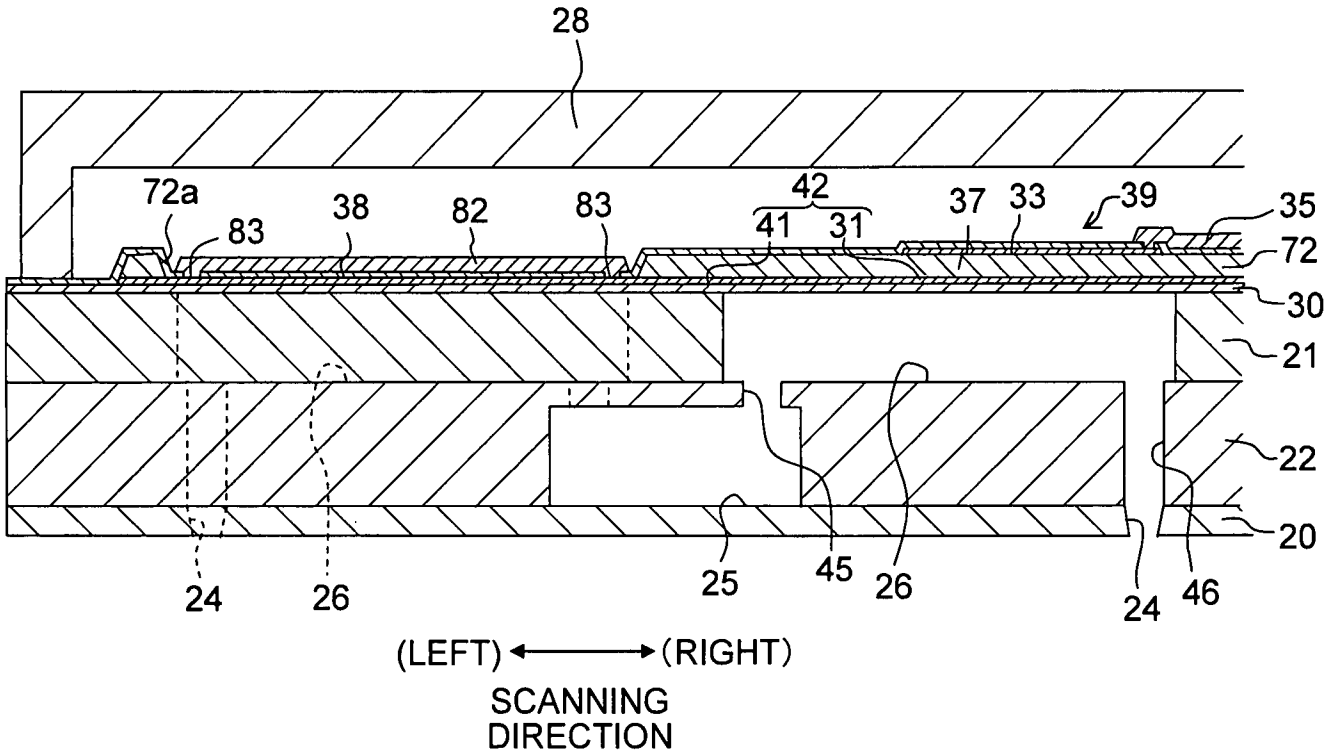
FIG. 11 is a cross-sectional view taken along a XI-XI line in FIG. 10.

As depicted in FIGS. 10 and 11, a piezoelectric layer 72 is arranged to cover a common electrode 42. Openings 72*a* are formed, by means the etching, in the piezoelectric layer 72 at areas each between two piezoelectric elements 39 which are adjacent in the conveyance direction. In each of the openings 72*a*, the common electrode 42 is in a state of being exposed from the piezoelectric layer 72. However, the common electrode 42 exposed from the openings 72*a* (the common electrode 42 having portions exposed from the openings 72*a*, respectively) is covered by the protective film 38 formed after forming upper electrodes 33.

In addition, the drive wires 35 and conductive wires 82 are arranged on the protective film 38 covering the openings 72*a*, at areas on the protective film 38 located between the two adjacent piezoelectric elements 39 in each of the piezoelectric element rows 40. In the above-described embodiment, FIG. 4 depicts that the piezoelectric layer 32 and the protective film 38 are arranged between the drive wires 35 and the common electrode 42 and between conductive wires 52 and the common electrode 42. On the other hand, FIG. 11 depicts a configuration that only the protective film 38 is arranged between the drive wires 35 and the common electrode 42 and between the conductive wires 82 and the common electrode 42, at the areas in which the openings 72*a* are formed, respectively. Note that each of the conductive wires 82 is conducted with the common electrode 42 via two conducting portions 83 formed to penetrate through the protective film 38.

Further, it is also allowable that the piezoelectric layer 32 is patterned per each of the pressure chambers 26, and that the piezoelectric portions 37 are completely separated or isolated among the plurality of pressure chambers 26. In such a case, the size (dimension) of the piezoelectric portions 37 is substantially same as that of the upper electrodes 33, or the size (dimension) of the upper electrodes 33 is made to be smaller to some extent that than of the piezoelectric portions 37.

In the embodiment, the protective film 38 is arranged to cover the plurality of piezoelectric elements 39. It is possible, however, to omit the protective film 38.

In the embodiment, the plurality of lower electrodes 31 are conducted with one another by the electrode conductive portion 41 to construct the common electrode 42 with respect to the plurality of piezoelectric elements 39, whereas the respective upper electrodes 33 are configured as the individual electrodes. It is allowable, however, that the lower electrodes serve as the individual electrodes and the upper electrodes serve as the common electrode.

In the piezoelectric actuator 23 of the embodiment, the plurality of piezoelectric elements 39 construct the four piezoelectric element rows 40. However, the number of the piezoelectric element row 40 is not limited to four. Namely, the present teaching is applicable to a piezoelectric actuator having two or more pieces of the piezoelectric element row 40.

In the piezoelectric actuator 23 of the embodiment, the conductive wires 52 are provided in the three piezoelectric element rows 40*b* to 40*d*, among the four piezoelectric element rows 40, which are disposed on the side opposite to the contact section 43 with respect to the piezoelectric element row 40*a* closest to the contact section 43 among the four piezoelectric element rows 40. It is allowable, however, that the conductive wires 52 are also provided in the piezoelectric element row 40*a* closest to the contact section 43.

In contract to the modification above, it is not necessarily indispensable that the conductive wires 52 are provided in all of the three piezoelectric element rows 40*b* to 40*d*. It is allowable that the conductive wires 52 are provided only in one of the three piezoelectric element rows 40*b* to 40*d*.

In the embodiment, the COF 50 as the wiring member is joined to the contact section 43 provided on the first channel substrate 21. It is allowable, however, that a part or component such as an IC chip, etc. which is different from the wiring member is electrically connected to the contact section 43.

The embodiment and the modifications thereof as described above are aspects in each of which the present teaching is applied to the piezoelectric actuator of an ink-jet head which jets an ink onto a recording paper to thereby print an image, etc., on the recording paper. However, the present teaching is also applicable to liquid discharging apparatuses usable for various kinds of applications other than the printing of image, etc. For example, the present teaching is applicable also to a liquid discharging apparatus which forms a conductive pattern on a surface of a substrate by discharging a conductive liquid onto the substrate, etc. Further, the piezoelectric actuator of the present teaching is not limited to those used for the purpose of imparting pressure to a liquid. For example, the present teaching is applicable also to an actuator configured to move a solid object, to an actuator configured to pressurize a gas, etc.

Next, an explanation will be given about a relevant teaching other than the present teaching as described above.

The relevant teaching relates to a piezoelectric actuator comprising:

a plurality of piezoelectric elements constructing a first piezoelectric element row and a second piezoelectric element row which are arrayed in a first direction on a substrate, the second piezoelectric element row being arranged side by side relative to the first piezoelectric element row in a second direction orthogonal to the first direction;

a contact section which is arranged on the substrate on a side opposite to the second piezoelectric element row in the second direction relative to the first piezoelectric element row, and to which a wiring member is joined; and a plurality of drive wires each of which is extended in the second direction from one of the plurality of piezoelectric elements toward the contact section, wherein each of the plurality of piezoelectric elements has a piezoelectric portion, a first electrode which is arranged on one side in a thickness direction of the piezoelectric portion, and a second electrode which is arranged on the other side in the thickness direction of the piezoelectric portion;

each of the drive wires is connected to the first electrode of one of the plurality of piezoelectric elements corresponding thereto;

the second electrodes of the plurality of piezoelectric elements are conducted with one another via an electrode conductive portion arranged between the second electrodes, and the second electrodes and the electrode conductive portion construct a common electrode for the plurality of piezoelectric elements;

the piezoelectric actuator further includes piezoelectric connecting portions which link the piezoelectric portions of the plurality of piezoelectric elements with each other;

drive wires included in the plurality of drive wires and corresponding to piezoelectric elements included in the plurality of piezoelectric elements and constructing the second piezoelectric element row are each extended toward the contact section while passing between two adjacent piezoelectric elements which are adjacent in the first direction among piezoelectric elements included in the plurality of piezoelectric elements and constructing the first piezoelectric element row; and dummy wires are arranged each between two adjacent piezoelectric elements which are adjacent in the first direction among the piezoelectric elements constructing the second piezoelectric element row, each of the dummy wires being separated from one of the drive wires.

Figure 12:
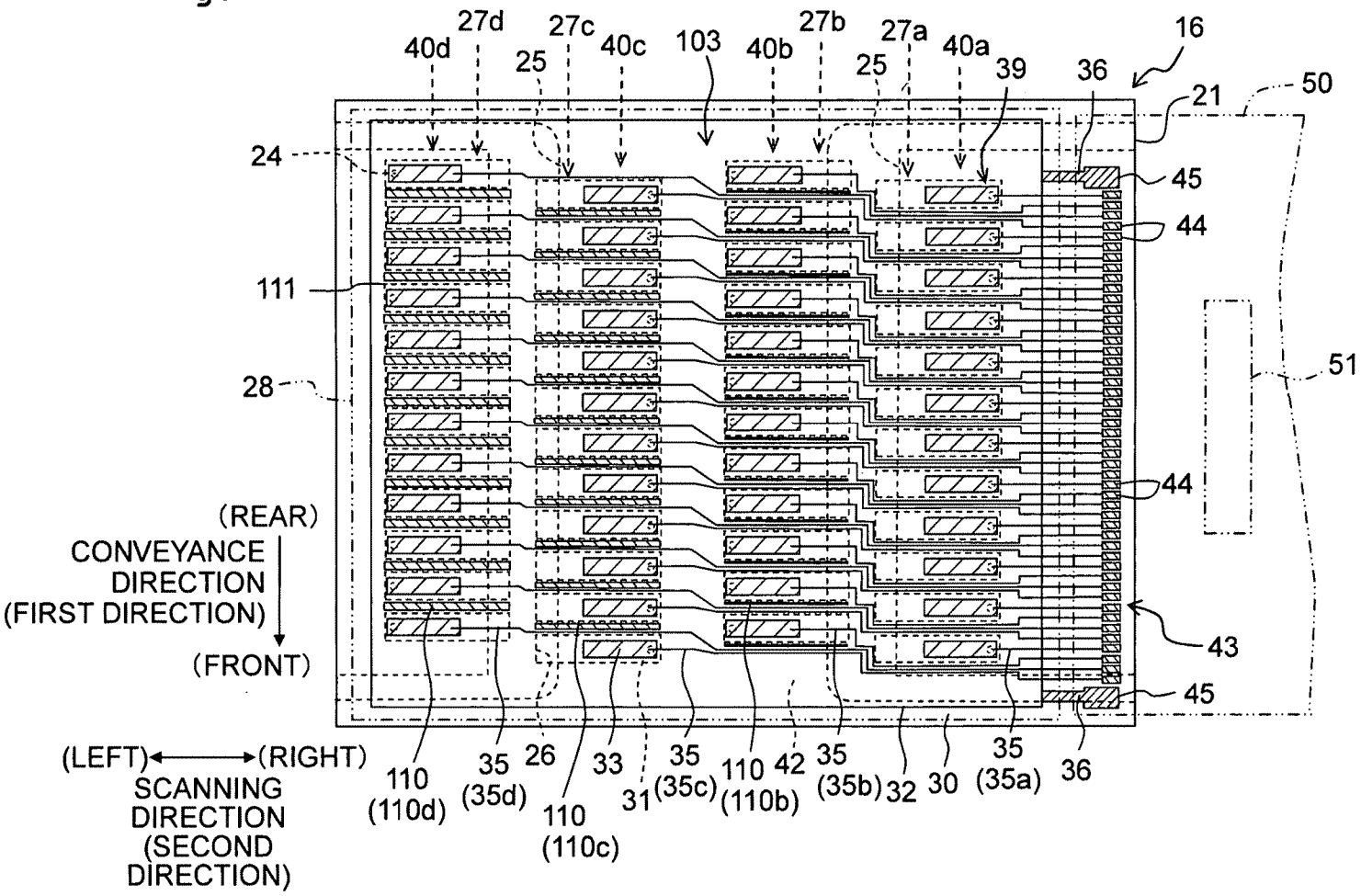
FIG. 12 is a top view of a head unit 16 according to a relevant teaching.

An explanation will be given about an embodiment of the above-described disclosed invention, with reference to FIG. 12. A piezoelectric actuator 103 has a plurality of piezoelectric elements 39 constructing four piezoelectric element rows 40 (40*a* to 40*d*) corresponding to four pressure chamber rows 27 (27*a* to 27*d*), respectively. In a similar manner as in the above-described embodiment, a piezoelectric layer 32 is formed to straddle over the four pressure chamber rows 27. Namely, there is provided a configuration wherein piezoelectric portions 37 of the plurality of piezoelectric elements 39 constructing the four piezoelectric element rows 40 are linked with one another via piezoelectric connecting portions 111 arranged in the piezoelectric layer 32 at portions located between adjacent pressure chambers 26 among the plurality of pressure chambers 26.

Drive wires 35 corresponding to the plurality of piezoelectric elements 39, respectively, constructing the four piezoelectric element rows 40 are drawn from the plurality of piezoelectric elements 39 rightward toward the contact section 43. Accordingly, in each of the three piezoelectric element rows 40*a* to 40*c* located on the right side with respect to the piezoelectric element row 40*d* located at the leftmost position, the drive wires 35 drawn from another or other piezoelectric element row or rows 40 pass through spaces between two adjacent piezoelectric elements 39 adjacent in the conveyance direction. On the other hand, in the piezoelectric element row 40*d* located at the leftmost position, no drive wires 35 from drawn from another or other piezoelectric element row or rows 40 pass through spaces between two adjacent piezoelectric elements 39 adjacent in the conveyance direction.

The residual stress in each of the piezoelectric elements 39 varies depending on whether or not a conductive film such as the drive wire 35, etc. is present on a portion, of the piezoelectric layer 32, between two adjacent piezoelectric elements 39. Accordingly, the residual stress of the piezoelectric element 39 varies among the four piezoelectric element rows 40. Considering this situation, in the configuration depicted in FIG. 12, dummy wires 110*d* are arranged each between two piezoelectric elements 39 adjacent in the conveyance direction in the leftmost piezoelectric element row 40*d*. The dummy wires 110*d* are not conducted with the upper electrodes 33 and the drive wires 35. Rather, the dummy wires 110*d* are electrodes arranged to be isolated, without being conducted with the common electrode 42, unlike the conductive wires 52 (see FIGS. 2 and 3) of the above-described embodiment. By arranging the dummy wires 110*d* between the two adjacent piezoelectric elements 39 in the piezoelectric element row 40*d*, it is possible to suppress the variation in residual stress with respect to the piezoelectric elements 39 in the remaining piezoelectric element rows 40*a* to 40*c*.

Further, the number of the drive wire 35, passing through the two adjacent piezoelectric elements 39, is different among the three piezoelectric element rows 40*a* to 40*c* located on the right side. Considering this, in the configuration depicted in FIG. 12, dummy wires 110*b* and 111*c* are arranged each between two piezoelectric elements 39 adjacent in the conveyance direction also in the piezoelectric element row 40*b* and the piezoelectric element row 40*c*, respectively, in a similar manner as in the piezoelectric element row 40*d*. Note that, however, the width of the dummy wires 110*c* in the piezoelectric element row 40*c* is smaller than the width of the dummy wires 110*d* in the piezoelectric element row 40*d*. Further, the width of the dummy wires 110*b* in the piezoelectric element row 40*b* is further smaller than the width of the dummy wires 110*c* in the piezoelectric element row 40*c*.

What is claimed is:

1. A piezoelectric actuator arranged on a substrate, the actuator comprising:

a plurality of piezoelectric elements aligned in a first direction on the substrate to form a first piezoelectric element row and a second piezoelectric element row which are arranged side by side in a second direction orthogonal to the first direction, each of the plurality of piezoelectric elements including a piezoelectric portion, a first electrode arranged on one side in a thickness direction of the piezoelectric portion, and a second electrode arranged on the other side in the thickness direction of the piezoelectric portion;

an electrode conductive portion electrically connecting the second electrodes with one another;

a contact section arranged on the substrate at a position on a side opposite to the second piezoelectric element row in the second direction relative to the first piezoelectric element row;

a plurality of drive wires each of which is extended in the second direction from one of the plurality of piezoelectric elements toward the contact section, each of the drive wires being connected to the first electrode of one of the plurality of piezoelectric elements, a part of the drive wires corresponding to the piezoelectric elements of the second piezoelectric element row being each extended toward the contact section while passing between two adjacent piezoelectric elements of the first piezoelectric element row which are adjacent in the first direction; and conductive wires arranged each between two adjacent piezoelectric elements of the second piezoelectric element row which are adjacent in the first direction, each of the conductive wires being conducted with the electrode conductive portion.

2. The piezoelectric actuator according to claim 1, wherein:

the plurality of piezoelectric elements further form a third piezoelectric element row which is arranged on a side opposite to the first piezoelectric element row in the second direction relative to the second piezoelectric element row;

the conductive wires include first conductive wires each of which is arranged between the two adjacent piezoelectric elements, of the second piezoelectric element row, adjacent in the first direction, and second conductive wires each of which is arranged between two adjacent piezoelectric elements, of the third piezoelectric element row, adjacent in the first direction; and electric resistance in the second conductive wires is lower than electric resistance in the first conductive wires.

3. The piezoelectric actuator according to claim 2, wherein a number of the second conductive wires each of which is arranged between the two adjacent piezoelectric elements the third piezoelectric element row is greater than a number of the first conductive wires each of which is arranged between the two adjacent piezoelectric elements of the second piezoelectric element row.

4. The piezoelectric actuator according to claim 3, wherein a total of a number of the drive wires and a number of the conductive wires which are arranged between two adjacent piezoelectric elements of the first, second and third piezoelectric element rows is same among the first, second and third piezoelectric element rows.

5. The piezoelectric actuator according to claim 4, wherein a width of the conductive wires and a width of the drive wires are same.

6. The piezoelectric actuator according to claim 2, wherein a width of the second conductive wires, each of which is arranged between the two adjacent piezoelectric elements of the third piezoelectric element row, is greater than a width of the first conductive wires, each of which is arranged between the two adjacent piezoelectric elements of the second piezoelectric element row.

7. The piezoelectric actuator according to claim 2, wherein the conductive wires include connecting portions arranged between the second and third piezoelectric element rows, and connecting the first conductive wires with the second conductive wires, respectively.

8. The piezoelectric actuator according to claim 1, wherein the contact section includes a plurality of first contact portions connected to the plurality of drive wires, respectively, and a second contact portion connected to the electrode conductive portion;

the first contact portions and the second contact portion are arranged side by side in the first direction; and the plurality of conductive wires, each of which is arranged between the two adjacent piezoelectric elements of the second piezoelectric element row, are constructed such that a conductive wire, among the plurality of conductive wires, being at a first distance from the second contact portion has a width greater than a width of another conductive wire being at a second distance from the second contact portion, the first distance being greater than the second distance.

9. The piezoelectric actuator according to claim 1, wherein the conductive wires are formed of a conductive material having an electric resistivity lower than an electric resistivity of the drive wires.

10. The piezoelectric actuator according to claim 1, wherein the conductive wires are formed of a conductive material having an electric resistivity lower than an electric resistivity of the electrode conductive portion.

11. The piezoelectric actuator according to claim 1, wherein a thickness of the conductive wires is greater than a thickness of the electrode conductive portion.

12. The piezoelectric actuator according to claim 1, wherein a length of the conductive wires in the second direction is longer than a length of the first electrode in the second direction.

13. The piezoelectric actuator according to claim 1, wherein a thickness of the conductive wires is same as a thickness of the drive wires.

14. The piezoelectric actuator according to claim 1, wherein the conductive wires and the drive wires are formed of a same conductive material.

15. The piezoelectric actuator according to claim 1, further comprising an insulating film configured to cover the plurality of piezoelectric elements, and having the drive wires and the conductive wires formed on the insulating film;

wherein a first conductive portion is formed in the insulating film to penetrate through the insulating film, at a position at which each of the drive wires and the first electrode of one of the plurality of piezoelectric elements are overlapped, each of the drive wires being conducted with the first electrode of one of the plurality of piezoelectric elements via the first conductive portion; and two second conductive portions are formed in the insulating film to penetrate through the insulating film, at positions at which the two conductive portions overlap with both end portions in the second direction of each of the conductive wires, and each of the conductive wires are conducted with the electrode conductive portion via the two second conductive portions.

16. A method for producing the piezoelectric actuator as defined in claim 1, the method comprising;

forming the piezoelectric portion of each of the plurality of piezoelectric elements;

forming the first electrode, of each of the plurality of piezoelectric elements, which is arranged on one side in the thickness direction of the piezoelectric portion;

forming the second electrode, of each of the plurality of piezoelectric elements, which is arranged on the other side in the thickness direction of the plurality of piezoelectric portion; and forming the drive wires corresponding to the plurality of piezoelectric elements, respectively, wherein during formation of the conductive wires, the conductive wires, each of which is arranged in an area between the two adjacent piezoelectric elements adjacent in the first direction, are formed in a film forming process which is same as a film forming process for forming the drive wires.

17. A piezoelectric actuator comprising:

a plurality of piezoelectric elements constructing a first piezoelectric element row and a second piezoelectric element row which are arrayed in a first direction on a substrate, the second piezoelectric element row being arranged side by side relative to the first piezoelectric element row in a second direction orthogonal to the first direction;

a contact section which is arranged on the substrate on a side opposite to the second piezoelectric element row in the second direction relative to the first piezoelectric element row, and to which a wiring member is joined;

a plurality of drive wires each of which is extended in the second direction from one of the plurality of piezoelectric elements toward the contact section, wherein each of the plurality of piezoelectric elements has a piezoelectric portion, a first electrode which is arranged on one side in a thickness direction of the piezoelectric portion, and a second electrode which is arranged on the other side in the thickness direction of the piezoelectric portion;

each of the drive wires is connected to the first electrode of one of the plurality of piezoelectric elements corresponding thereto;

the second electrodes of the plurality of piezoelectric elements are conducted with one another via an electrode conductive portion arranged between the second electrodes, and the second electrodes and the electrode conductive portion construct a common electrode for the plurality of piezoelectric elements;

the piezoelectric actuator further includes piezoelectric connecting portions which link the piezoelectric portions of the plurality of piezoelectric elements with each other;

drive wires included in the plurality of drive wires and corresponding to piezoelectric elements included in the plurality of piezoelectric elements and constructing the second piezoelectric element row are each extended toward the contact section while passing between two adjacent piezoelectric elements which are adjacent in the first direction among piezoelectric elements included in the plurality of piezoelectric elements and constructing the first piezoelectric element row; and dummy wires are arranged each between two adjacent piezoelectric elements which are adjacent in the first direction among the piezoelectric elements constructing the second piezoelectric element row, each of the dummy wires being separated from one of the drive wires.

* * * * *